US012024994B1

(12) United States Patent
Alsulaim et al.

(10) Patent No.: US 12,024,994 B1
(45) Date of Patent: Jul. 2, 2024

(54) HYBRID IMPRESSION BLOCK

(71) Applicant: SAUDI ARABIAN OIL COMPANY, Dhahran (SA)

(72) Inventors: Abdullah T. Alsulaim, Dammam (SA); Fahad M. Al-Ajmi, Dhahran (SA); Saad Hamid, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/301,373

(22) Filed: Apr. 17, 2023

(51) Int. Cl.

| | |
|---|---|
| ***E21B 47/00*** | (2012.01) |
| ***E21B 37/02*** | (2006.01) |
| ***E21B 47/002*** | (2012.01) |
| ***E21B 47/098*** | (2012.01) |

(52) U.S. Cl.
CPC ..... *E21B 47/006* (2020.05); *E21B 37/02* (2013.01); *E21B 47/002* (2020.05); *E21B 47/098* (2020.05)

(58) Field of Classification Search
CPC ..... E21B 47/00; E21B 47/001; E21B 47/006; E21B 37/02; E21B 47/09; E21B 47/002; E21B 47/098; E21B 21/00; E21B 37/00; E21B 12/06
See application file for complete search history.

(56) References Cited

U.S. PATENT DOCUMENTS

| | | | | |
|---|---|---|---|---|
| 3,583,504 | A | 6/1971 | Aalund | |
| 5,348,086 | A * | 9/1994 | Trout | E21B 31/16 166/99 |
| 8,061,053 | B2 | 11/2011 | Gillan | |
| 9,745,832 | B2 * | 8/2017 | Nicol | E21B 31/12 |
| 9,771,771 | B2 | 9/2017 | Williams et al. | |
| 10,822,882 | B2 | 11/2020 | Brown | |
| 11,414,984 | B2 * | 8/2022 | Gooneratne | E21B 47/08 |
| 2013/0207301 | A1 * | 8/2013 | Guidry | B29C 33/3857 264/220 |
| 2016/0084064 | A1 * | 3/2016 | Clemens | E21B 47/09 166/301 |

(Continued)

FOREIGN PATENT DOCUMENTS

| | | | | |
|---|---|---|---|---|
| CA | 2434770 A1 * | 1/2005 | | E21B 47/0915 |
| CN | 211474060 U | 9/2020 | | |

(Continued)

*Primary Examiner* — Nicole Coy
*Assistant Examiner* — Yanick A Akaragwe
(74) *Attorney, Agent, or Firm* — Osha Bergman Watanabe & Burton LLP

(57) ABSTRACT

An apparatus for evaluating an obstruction in a conduit of a tubular includes a first cylindrical rod connected to a deployment device configured to deploy the first cylindrical rod into the conduit of the tubular; a second cylindrical rod connected to the first cylindrical rod; an outer sleeve movable between a first position and a second position; and an impression block connected to the second cylindrical rod. The impression block is configured to obtain an impression of the obstruction. The second cylindrical rod has a diameter larger than a diameter of the first cylindrical rod, when the outer sleeve is concentrically disposed around the second cylindrical rod in the first position and concentrically disposed around the first cylindrical rod after an interaction between the outer sleeve and the obstruction. The outer sleeve includes a plurality of panels connected to one another by a plurality of stretchable elements.

20 Claims, 18 Drawing Sheets

(56) References Cited

U.S. PATENT DOCUMENTS

| | | | | |
|---|---|---|---|---|
| 2016/0102527 | A1* | 4/2016 | Manson | E21B 41/00 166/243 |
| 2021/0172291 | A1* | 6/2021 | Al-Qasim | E21B 47/00 |
| 2023/0082225 | A1* | 3/2023 | Nafa | E21B 47/01 166/250.01 |

FOREIGN PATENT DOCUMENTS

| | | | | |
|---|---|---|---|---|
| WO | 1998/050675 | A1 | 11/1998 | |
| WO | WO-2005108737 | A1 * | 11/2005 | E21B 31/18 |
| WO | WO-2014077697 | A1 * | 5/2014 | E21B 31/00 |

* cited by examiner

HYBRID IMPRESSION BLOCK

BACKGROUND

In the oil and gas industry, hydrocarbons are located in porous rock formations beneath the Earth's surface. Hydrocarbons are accessed by drilling wells into the formation(s). A well is a series of concentric holes drilled into the surface of the Earth where each hole is supported by a casing string cemented in place. In order to produce the hydrocarbons, a production string is often run and set within the inner-most casing string. A production string is a series of tubulars connected to one another. The production string is used to provide a conduit for hydrocarbon migration to the surface. Often, other production equipment, such as pumps and separators, are included in the production string to aid production of the hydrocarbons.

During the life of a well, the well may require one or more wellbore interventions to maintain the well, secondarily complete the well, or replace downhole equipment. Most wellbore interventions require through-tubing access to the well. Through-tubing access is a method that includes running tools through the inside of the production tubing to perform operations downhole. Prior to running through-tubing tools, it is important to drift the production tubing. Drifting conventionally consists of running a tool, having a diameter assumed to be the accessible inner diameter of the production tubing, through the inside of the production tubing to determine the wellbore accessibility, i.e., the maximum size tool that may be run through the production tubing. Often, the drifting tool is unable to be run through the entirety of the production tubing due to obstructions.

An obstruction may be a signal of a potential tubular collapse, broken off tools, debris, or built up scale. Analyzation of an obstruction is very difficult due to the decreased visibility, harshness, and depth of the downhole environment. Once an obstruction is identified, multiple runs of progressively smaller drift tools are necessary to determine the extent of the obstruction. Multiple runs of drift tools are costly, time consuming, and invite more time for well control incidents to occur.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods, apparatuses, and systems for evaluating an obstruction in a conduit of a tubular. Embodiments of the apparatus include a first cylindrical rod connected to a deployment device configured to deploy the first cylindrical rod into the conduit of the tubular; a second cylindrical rod connected to the first cylindrical rod, wherein the second cylindrical rod has a diameter larger than a diameter of the first cylindrical rod; an outer sleeve movable between a first position and a second position; and an impression block connected to the second cylindrical rod, wherein the impression block is configured to obtain an impression of the obstruction. The outer sleeve is concentrically disposed around the second cylindrical rod in the first position and concentrically disposed around the first cylindrical rod after an interaction between the outer sleeve and the obstruction.

The outer sleeve includes a plurality of panels connected to one another by a plurality of stretchable elements.

Embodiments of the method include running a deployment device connected to a first cylindrical rod and a second cylindrical rod into the conduit of the tubular, wherein the second cylindrical rod has a diameter larger than a diameter of the first cylindrical rod; positioning an outer sleeve, comprising a plurality of stretchable elements connecting a plurality of panels to one another, in a first position, wherein the first position comprises the outer sleeve disposed concentrically around the second cylindrical rod; detecting the obstruction by shifting the outer sleeve from the first position to a second position due to an interaction between the obstruction and the outer sleeve, wherein the second position comprises the outer sleeve concentrically disposed around the first cylindrical rod; and obtaining an impression of the obstruction using an impression block connected to the second cylindrical rod.

Embodiments of the system include a deployment device connected to a first cylindrical rod and a second cylindrical rod. The second cylindrical rod has a diameter larger than a diameter of the first cylindrical rod. The system further includes a first cylindrical sleeve stretchable to be disposed concentrically around the second cylindrical rod. The first cylindrical sleeve is configured to disconnect from a first underlay due to a force of impact created by an interaction with the obstruction and contract and shift around the first cylindrical rod. The system detects the obstruction by a contraction of the first cylindrical sleeve. The system further includes an impression block connected to the second cylindrical rod.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Herein, the term "cylindrical" is not meant to be limiting and may be used to not only mean a form or a shape of a cylinder, but also a form or a shape of a truncated cone.

When obstructions are faced while drifting tubing, multiple runs of progressively smaller drift tools are necessary to determine the extent of the obstruction. Multiple runs of drift tools are costly, time consuming, and invite more time for well control incidents to occur. Accordingly, a tool that is able to reduce the number of drifting runs to determine the accessible inner diameter of the tubular is beneficial.

As such, embodiments disclosed herein include apparatuses, systems, and methods for evaluating an obstruction in a conduit of a tubular and determining the accessible inner diameter of the tubular using an apparatus. The apparatus has the ability to change in size until the apparatus is small enough to bypass the obstruction. When the apparatus is pulled to the surface, the accessible inner diameter of the tubular is determined by the reduced size of the apparatus.

Figure 1:
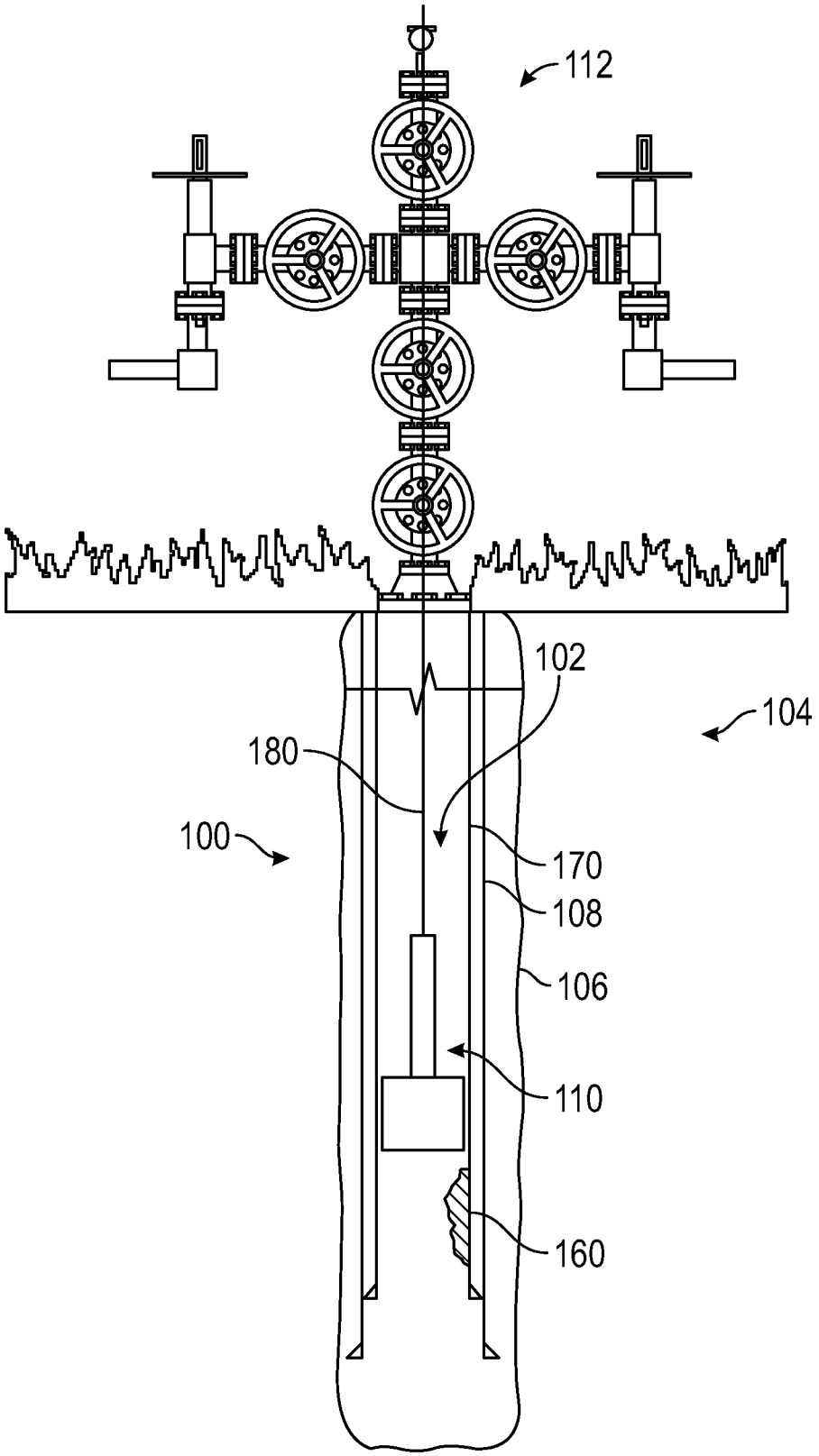
FIG. 1 shows a schematic view of a system in accordance with one or more embodiments.

FIG. 1 shows a schematic cross-sectional view illustrating a system 100 for evaluating an obstruction 160 in a conduit 102 of a tubular 170 located in a well 104 in accordance with one or more embodiments. The well 104 shown in FIG. 1 is shown for exemplary purposes and is not meant to be limiting. A well having any type of well schematic, design, or trajectory may be used herein without departing from the scope of the disclosure.

In accordance with one or more embodiments, the well 104 includes a wellbore 106 drilled into the surface of the Earth. A casing string 108 is cemented in place in the wellbore 106. A tubular 170 is disposed within the casing string 108. The tubular 170 may be a production string in accordance with one or more embodiments. The well 104 further includes a production tree 112 housing the surface-extending portion of the casing string 108 and the surface-extending portion of the tubular 170. The production tree 112 is a series of spools and valves that are used to enable production of fluids from the well 104 and enable downhole access to the well 104. Herein, the term "production tree 112" may encompass the wellhead and the tubing head without departing from the scope of the disclosure herein.

The system 100 includes a deployment device 180 connected to an apparatus 110. The deployment device 180 is used to raise and lower the apparatus 110 inside of the tubular 170. The deployment device 180 may be any type of deployment device known in the art, such as coiled tubing, slickline, or wireline. An input may direct the deployment device 180 to extend the apparatus 110 further into the tubular 170.

The system 100 detects the presence of the obstruction 160 in the tubular when the apparatus 110 hits the obstruction 160, and a force of impact, created by the interaction between the obstruction 160 and the apparatus 110, reduces the size of the apparatus 110. The apparatus 110 is further outlined in FIGS. 3A-FIG. 7D.

Figure 2:
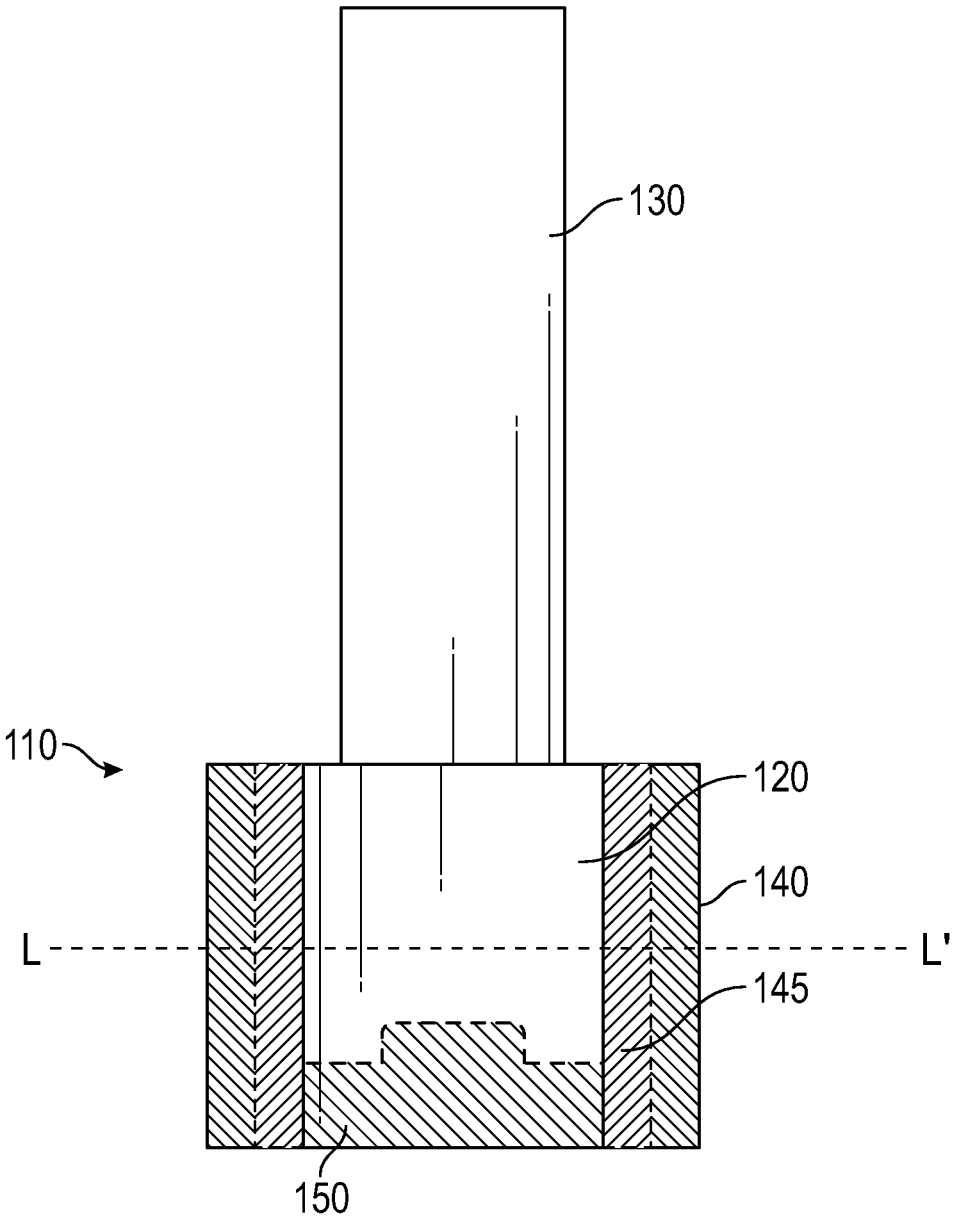
FIG. 2 shows a longitudinal cross-section view of an apparatus in accordance with one or more embodiments.

FIG. 2 shows a longitudinal cross-section view of the apparatus 110 in accordance with one or more embodiments. The apparatus 110 may include a first cylindrical rod 130, a second cylindrical rod 120, and one or more stretchable cylindrical sleeves. Embodiments of the apparatus 110 shown herein include two stretchable cylindrical sleeves: an outer sleeve 140 and an inner sleeve 145. However, the disclosure is not meant to be limiting to two sleeves, rather, the apparatus 110 may include one or more stretchable cylindrical sleeves (as described by outer sleeve 140 and inner sleeve 145) without departing from the scope of the disclosure herein.

In accordance with one or more embodiments, the first cylindrical rod 130 and the second cylindrical rod 120 are formed in the shape of a cylinder and may have a solid body or a hollow body without departing from the scope of the disclosure herein. Furthermore, the first cylindrical rod 130 and the second cylindrical rod 120 may be made of any durable material that can withstand downhole conditions, such as a metal alloy. In further embodiments, the first cylindrical rod 130 has a smaller outer diameter than the second cylindrical rod 120. The first cylindrical rod 130 and the second cylindrical rod 120 may be connected to one another using any connection known in the art, such as a welded connection, a threaded connection, etc. In other embodiments, the first cylindrical rod 130 and the second cylindrical rod 120 may be machined as one component.

In accordance with one or more embodiments, the outer sleeve 140 and the inner sleeve 145 are extendable/stretchable and are concentrically disposed around the second cylindrical rod 120. In accordance with one or more embodiments, the inner sleeve 145 is located between the outer sleeve 140 and the second cylindrical rod 120. That is, the outer sleeve 140 has a larger diameter than the inner sleeve 145 when the outer sleeve 140 and the inner sleeve 145 are concentrically disposed around the second cylindrical rod 120.

The make-up of the outer sleeve 140 and the inner sleeve 145 and how the outer sleeve 140 and the inner sleeve 145 are connected to one another/disposed around the second cylindrical rod 120 is outlined below in FIGS. 8-9D. The shapes of the second cylindrical rod 120, the outer sleeve 140, and the inner sleeve 145 may be modified in response to a change in a structural design of the apparatus 110 without departing from the scope of the disclosure herein.

In accordance with one or more embodiments, the outer sleeve 140 is movable between a first position and a second position. The first position of the outer sleeve 140 is shown in FIG. 2. The first position of the outer sleeve 140 includes the outer sleeve 140 concentrically disposed around the second cylindrical rod 120. The second position of the outer sleeve 140 includes the outer sleeve 140 concentrically disposed around the first cylindrical rod 130 after an interaction between the outer sleeve 140 and an object, such as the obstruction 160 shown in FIG. 1. The movement between the first position and the second position of the outer sleeve 140 is shown in detail in FIGS. 3A to 3D below.

In further embodiments, there may be more than two cylindrical sleeves (a second to the n-th cylindrical sleeves) wrapped concentrically around one another and around the second cylindrical rod 120 without departing from the scope of the disclosure herein. N is an integer greater than two, and the second to n-th cylindrical sleeves are able to disconnect from a second to an n-th underlays due to a force of impact created by the interaction with the obstruction 160 and contract and shift around the first cylindrical rod 130.

In further embodiments, an impression block 150 is connected to the inner surface of the second cylindrical rod 120. The impression block 150 and the second cylindrical rod 120 may be connected to one another using any connection known in the art, such as a welded connection, a threaded connection, etc. In other embodiments, the impression block 150 and the second cylindrical rod 120 may be machined as one component.

The impression block 150 may be made of a solid material formed in a shape that may fit within the conduit 102 of the tubular 170, such as a cylinder. In accordance with one or more embodiments the impression block 150 may be made out of a relatively soft metal, such as lead, so that the impression block 150 may be easily deformed when interacting with the obstruction 160.

The apparatus 110 may obtain an impression of the obstruction 160 with the impression block 150 and use the impression to identify the nature of the obstruction 160. In some embodiments, the impression block 150 may provide a clue as to the cause of the obstruction 160 by identifying the shape of the obstruction 160, for instance, an emerged deformation in the tubular 170, which may suggest the presence of collapsed rock wall in the wellbore 106.

In accordance with one or more embodiments, the impression block 150 has an outer diameter smaller than the inner diameter of the inner sleeve 145 such that the impression block 150 will only interact with obstructions 160 that are large enough to interact with the outer sleeve 140 and the inner sleeve 145.

FIG. 2 shows the outer sleeve 140 and inner sleeve 145, in the first and third positions respectively, disposed concentrically around both the second cylindrical rod 120 and the impression block 150. FIG. 2 also shows the impression block 150 located flush inside the inner sleeve 145 while in the third position.

However, without departing from the scope of the disclosure herein, the impression block 150 may extend past the downhole end of the sleeves 140, 145 and the sleeves 140, 145 may not be disposed around the impression block 150. Rather, the second cylindrical rod 120 may extend past the downhole end of the sleeves 140, 145 and the impression block 150 may be connected to the extended end of the second cylindrical rod 120 in accordance with one or more embodiments.

Particularly, FIGS. 3A to 3D show perspective views of the apparatus 110 and illustrate changes in the shape and/or position of the outer sleeve 140 and the inner sleeve 145 in accordance with one or more embodiments. The apparatus 110 is shown in a tubular 170 having an obstruction 160, as outline above in FIG. 1. Components shown in FIGS. 3A to 3D that are described in previous figures have not been redescribed for purposes of readability and have the same description and function as outlined formerly.

Figure 3A:
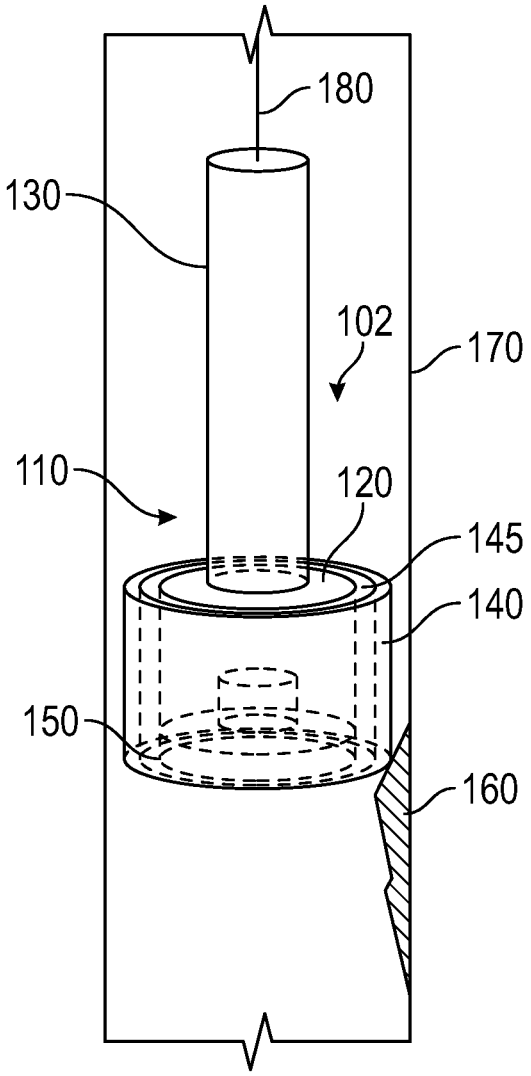
FIGS. 3A to 3D show perspective views of an apparatus in accordance with one or more embodiments.

Specifically, FIG. 3A illustrates the configuration of the apparatus 110 in the first position and before the apparatus' 110 interaction with the obstruction 160. The deployment device 180 is attached to the apparatus 110 to lower or pull the apparatus 110 into or from the tubular 170. In particular, the deployment device 180 is connected to the first cylindrical rod 130. The deployment device 180 is connected to the first cylindrical rod 130 using any connection known in the art. For example, the deployment device 180 may have a bottom hole assembly that is connected to the first cylindrical rod 130. In other embodiments, the deployment device 180 may have a cable head that is used to connect the first cylindrical rod 130 to the deployment device 180.

In accordance with one or more embodiments, the apparatus 110 includes the first cylindrical rod 130, the second cylindrical rod 120, the outer sleeve 140, and the inner sleeve 145. The inner sleeve 145 is stretched to encircle the second cylindrical rod 120. In further embodiments, the outer sleeve 140 may also be stretched to encircle the inner sleeve 145. Herein, the term stretching may refer to extending, or enlarging, the circumference and diameter of the inner sleeve 145 and the outer sleeve 140.

The inner sleeve 145 and the outer sleeve 140 may be stretched using stretchable elements. The stretchable elements may be any element that allows the circumference and diameter of the inner sleeve 145 and the outer sleeve 140 to expand. For example, the stretchable elements may include coils or elastic bands embedded in the surface of the sleeves, a foldable sheet, or stackable panels. In accordance with one or more embodiments, the inner sleeve 145 and the outer sleeve 140 may be both stretchable and retractable.

To realize sufficient stretchability but also reversibility of the expansion of the inner sleeve 145 and the outer sleeve 140, the extensible components may be made of shear-resistant infrangible materials. Further, a suitable element (mechanical pins, hooks, adhesive agents, electromagnetic propensities, etc.) may be incorporated to allow attachment of the stretched outer sleeve 140 and inner sleeve 145 to their underlays (the inner sleeve 145 and the second cylindrical rod 120, respectively).

When the outer sleeve 140 hits the obstruction 160 while the apparatus 110 is being lowered into the tubular 170 using the deployment device 180, a force of the impact created by the interaction breaks the attachment of the outer sleeve 140 to the inner sleeve 145. Furthermore, the force of impact may drive the outer sleeve 140 up-hole and away from the inner sleeve 145, as shown in FIG. 3B.

Figure 3B:
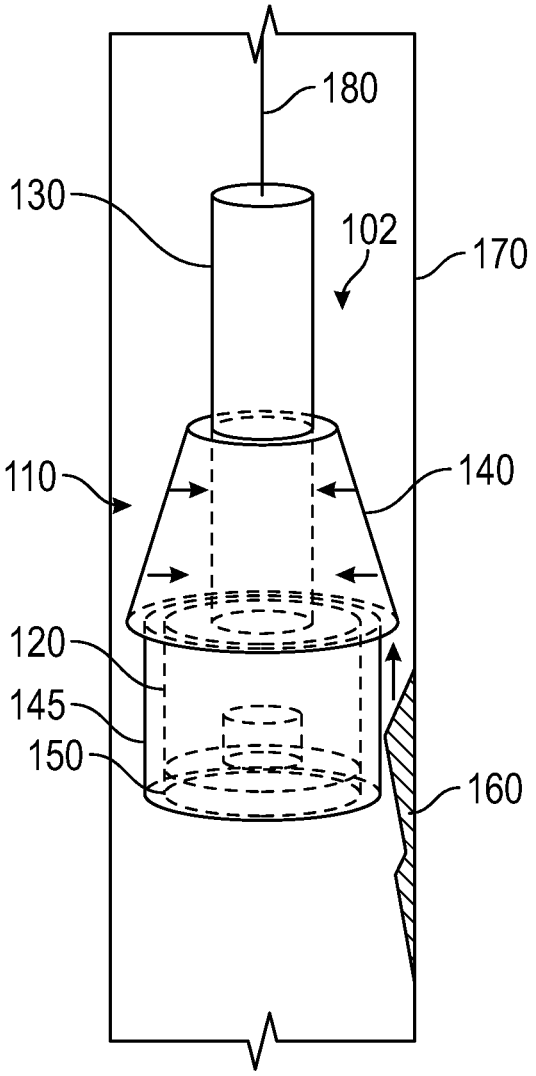

FIG. 3B shows a transient configuration of the apparatus 110 according to one or more embodiments. FIG. 3B shows the contraction and shifting of the outer sleeve 140 after the interaction with the obstruction 160. FIG. 3B also shows the transition of the outer sleeve 140 between the first position and the second position.

In accordance with one or more embodiments and depending on the size of the obstruction 160, the force of impact from the interaction between the outer sleeve 140 and the obstruction 160 disconnects only the outer sleeve 140 from the inner sleeve 145, without causing detachment of inner sleeve 145 from the second cylindrical rod 120. That is, the suitable mode of attachment that connects the inner sleeve 145 to the second cylindrical rod 120 is not disturbed by the obstruction 160.

In accordance with one or more embodiments, the outer sleeve 140 begins to move from the second cylindrical rod 120 towards the first cylindrical rod 130 due to the force of the impact from the collision. Due to the first cylindrical rod 130 having a smaller diameter than the second cylindrical rod 120 and the nature of the stretchable elements, the outer sleeve 140 begins to shrink after the attachment to the inner sleeve 145 is broken. FIG. 3B shows that the outer sleeve 140 may form a shape similar to a truncated cone while transitioning between the first position and the second position.

Figure 3C:
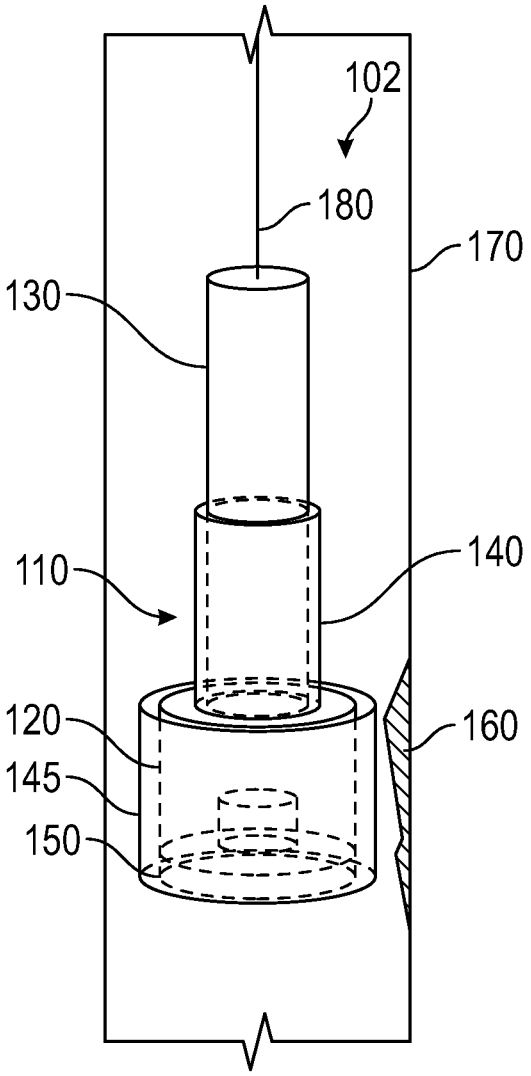

FIG. 3C shows the apparatus 110 after the collision with the obstruction 160 in accordance with one or more embodiments. FIG. 3C also shows the outer sleeve 140 in the second position. In accordance with one or more embodiments, the outer sleeve 140 moves to encircle the first cylindrical rod 130 upon receiving the force of impact, in the form of kinetic energy, from the interaction with the obstruction 160. When stretchable materials are used in the outer sleeve 140, the stored elastic potential energy within the stretchable materials may be utilized to propel the movement of the outer sleeve 140 towards the first cylindrical rod 130, whose diameter is smaller than the second cylindrical rod's 120 diameter.

The system 100 may detect the presence and/or approximate location of the obstruction 160 by any means known in the art. For example, the deployment device 180 may have a depth chart at the surface tracking the depth of the apparatus 110 as it is lowered or raised in the tubular 170. Furthermore, the deployment device 180 may have a sensor at the surface that tracks the amount of tension and slack that is seen in the deployment device 180. Thus, when the apparatus 110 interacts with the obstruction 160, an amount of slack may be seen at the surface. The tension/slack sensor and the depth tracker may be calibrated in a computer. Thus, an operator may compare the depth to the time slack was seen across the deployment device 180 in order to note at what depth the obstruction is located.

After the apparatus 110 has completed the drift of the tubular 170 and is retrieved at the surface, the size of the apparatus 110 may indicate the accessible inner diameter of the tubular 170. That is, an operator may note how many sleeves were broken away from their underlays which indicates the extend of the obstruction's 160 size within the tubular 170.

Figure 3D:
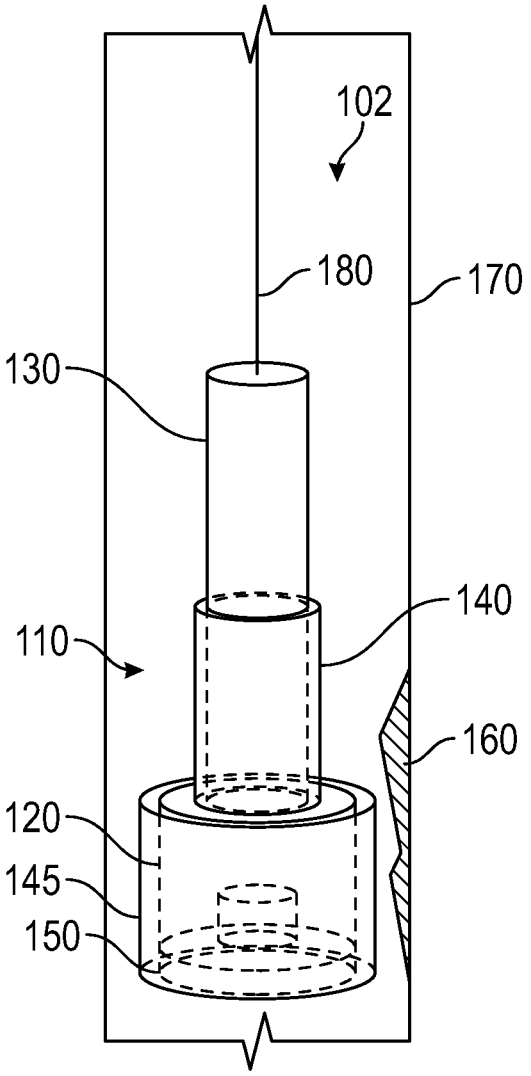

FIG. 3D shows the advancement of the apparatus 110 after the outer sleeve's 140 contraction in accordance with one or more embodiments. For example, the apparatus 110 may successfully pass the site of the obstruction 160 if the obstruction 160 does not extend to the outer surface of the inner sleeve 145 and the outer sleeve 140 has been contracted due to the interaction with the obstruction 160.

FIGS. 4A to 4F show perspective views of the apparatus 110 and illustrate changes in the shapes and/or positions of the outer sleeve 140 and the inner sleeve 145 in accordance with one or more embodiments. Specifically, FIGS. 4A to 4F show the obstruction 160 having a size large enough to interact with both the outer sleeve 140 and the inner sleeve 145.

In accordance with one or more embodiments, the apparatus 110 is controlled by the deployment device 180 and advances in the tubular 170. The circumferences of the inner sleeve 145 and the outer sleeve 140 are extendable when springs embedded into the inner sleeve 145 and outer sleeve 140 are stretched. In other embodiments, if folded sheets or panels that make up the inner sleeve 145 and outer sleeve 140 are pulled out, the circumferences and the diameters of the inner sleeve 145 and outer sleeve 140 may be lengthened. Components constituting the surface of the outer sleeve 140 and the inner sleeve 145 may be made of shear-resistant infrangible materials.

Figure 4A:
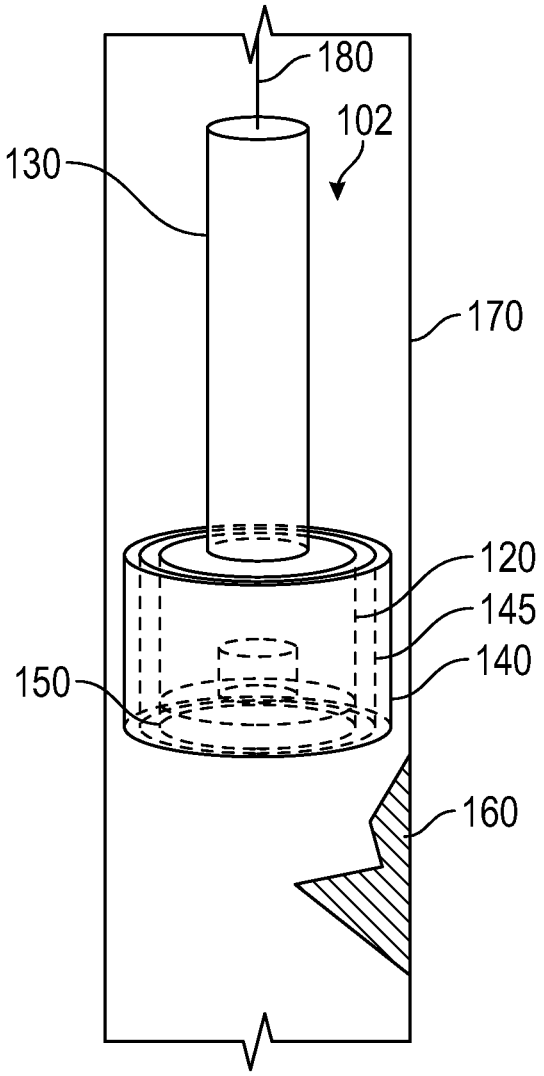
FIGS. 4A to 4F show perspective views of an apparatus in accordance with one or more embodiments.

FIGS. 4A to 4F show the outer sleeve 140 moving between the first position and the second position and the inner sleeve 145 moving between a third position and a fourth position. In accordance with one or more embodiments, the first position includes the outer sleeve 140 concentrically disposed around the second cylindrical rod 120 as shown in FIG. 4A. The second position includes the outer sleeve 140 concentrically disposed around the first cylindrical rod 130 after an interaction between the outer sleeve 140 and the obstruction 160 as shown in FIGS. 4C to 4F.

Figure 4B:
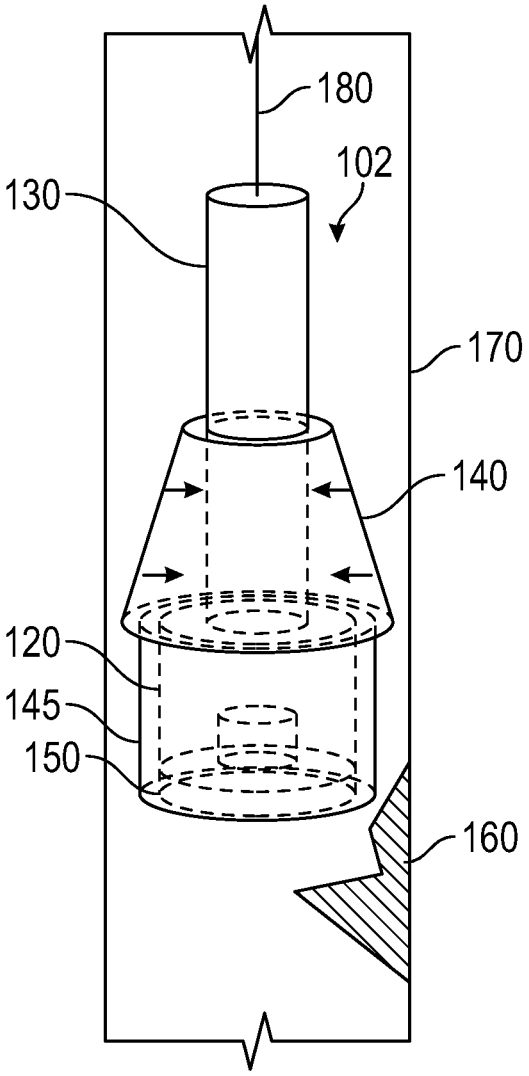
Figure 4C:
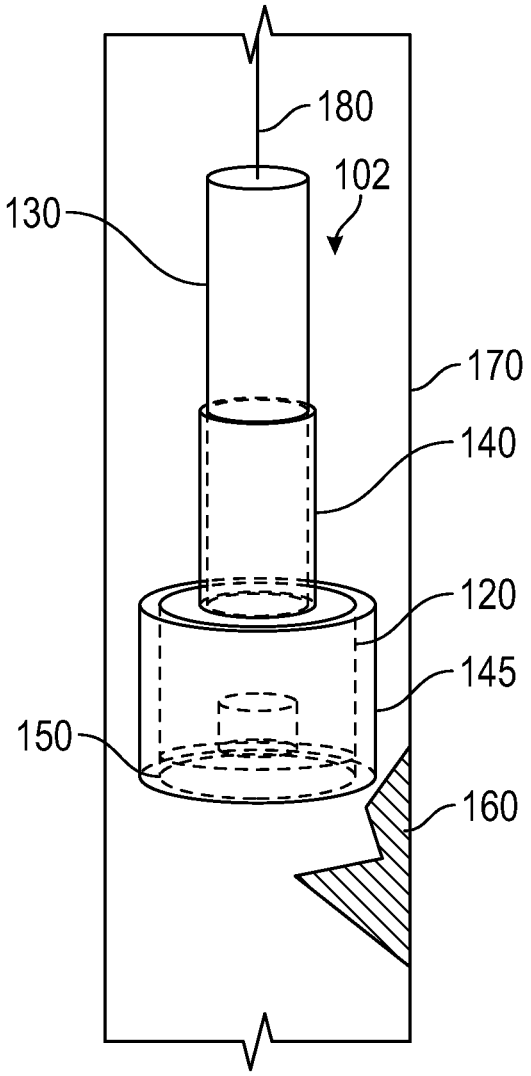

The third position includes the inner sleeve 145 concentrically disposed around the second cylindrical rod 120 as shown in FIGS. 4A to 4C. The fourth position includes the inner sleeve 145 concentrically disposed around the first cylindrical rod 130 after an interaction between the inner sleeve 145 and the obstruction 160 as shown in FIGS. 4E and 4F.

In the third position, the inner sleeve 145 is stretched to encircle the second cylindrical rod 120, and in some embodiments, the outer sleeve 140 is stretched to encircle the inner sleeve 145, as shown in FIG. 4A. The stretched outer sleeves 140 remains connected to its underlay, the inner sleeve 145, and the inner sleeve 145 remains connected to its underlay, the second cylindrical rod 120, unless disturbed by an external force.

When the outer sleeves 140 collides with the obstruction 160, a force of the impact created by the interaction breaks the attachment of the outer sleeve 140 to the inner sleeve 145, and the outer sleeve 140 is pushed away from the inner sleeve 145.

FIG. 4B shows a transient configuration of the apparatus 110 according to one or more embodiments. FIG. 4B shows the contraction and shifting of the outer sleeve 140 after the collision with the obstruction 160. The force of impact from the interaction between the outer sleeve 140 and the obstruction 160 causes disconnection of the outer sleeve 140 from the inner sleeve 145. Depending on the shape and size of the obstruction 160, the inner sleeve 145 may not be affected by the obstruction 160 until the apparatus 110 moves further down the tubular 170, as shown in FIGS. 4A to 4F. In other embodiments, the inner sleeve 145 and the outer sleeve 140 may be affected by the obstruction 160 simultaneously.

Accordingly, the outer sleeve 140 moves away from the obstruction 160 due to the force of the impact from the collision. Simultaneously, the outer sleeve 140 starts shrinking after the attachment to the inner sleeve 145 is lost. Thus, the released portion of the outer sleeve 140 (the upper portion of the outer sleeve 140 in FIG. 4B) shrinks first, creating a truncated cone shape.

FIG. 4C shows a transition of the outer sleeve 140 from the first position after the collision with the obstruction 160. In the second position, the outer sleeve 140 encircles the first cylindrical rod 130 after receiving the force of impact, in the form of kinetic energy. When stretchable materials are used in the outer sleeve 140, the stored elastic potential energy may be utilized to propel the movement.

Figure 4D:
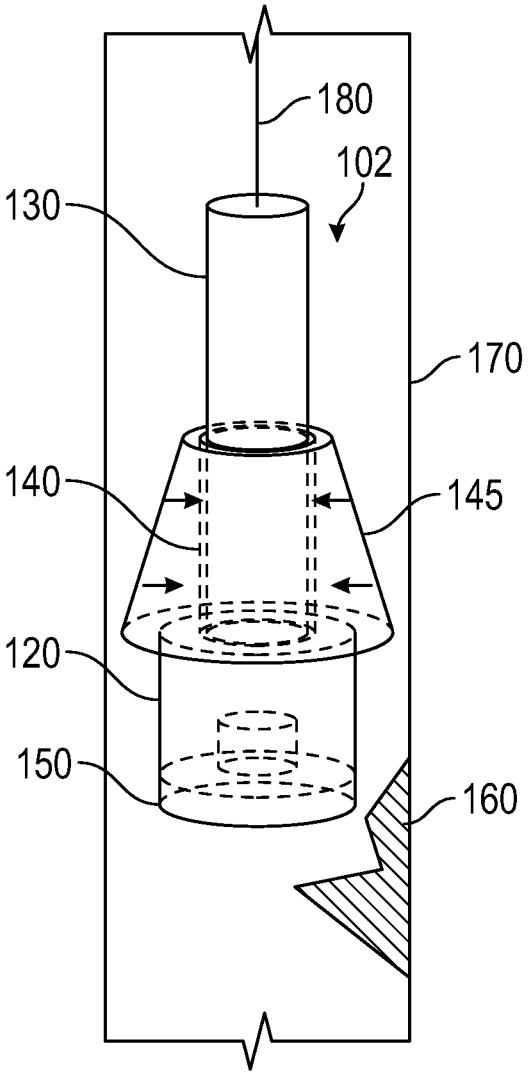
Figure 4E:
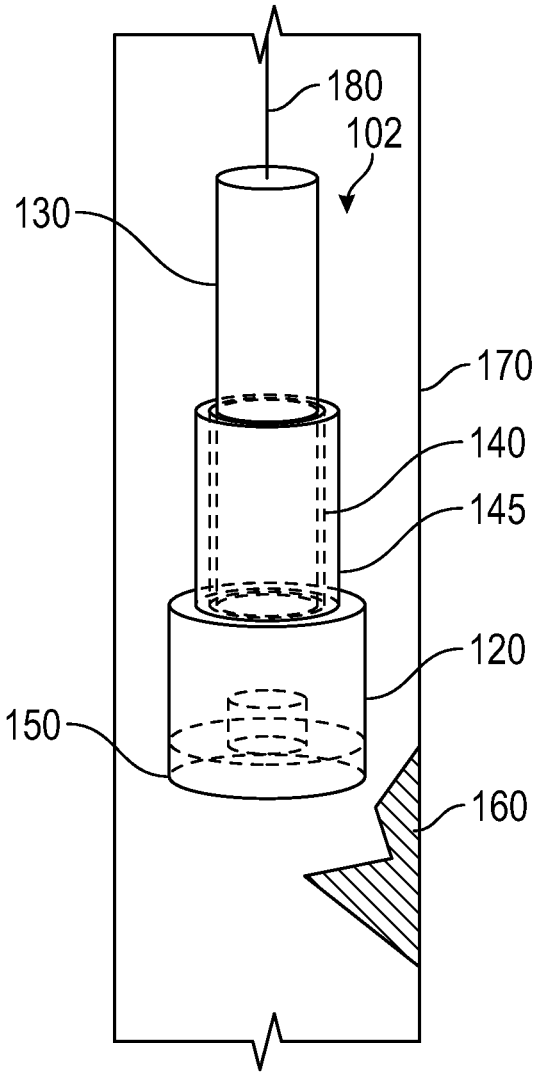
Figure 4F:
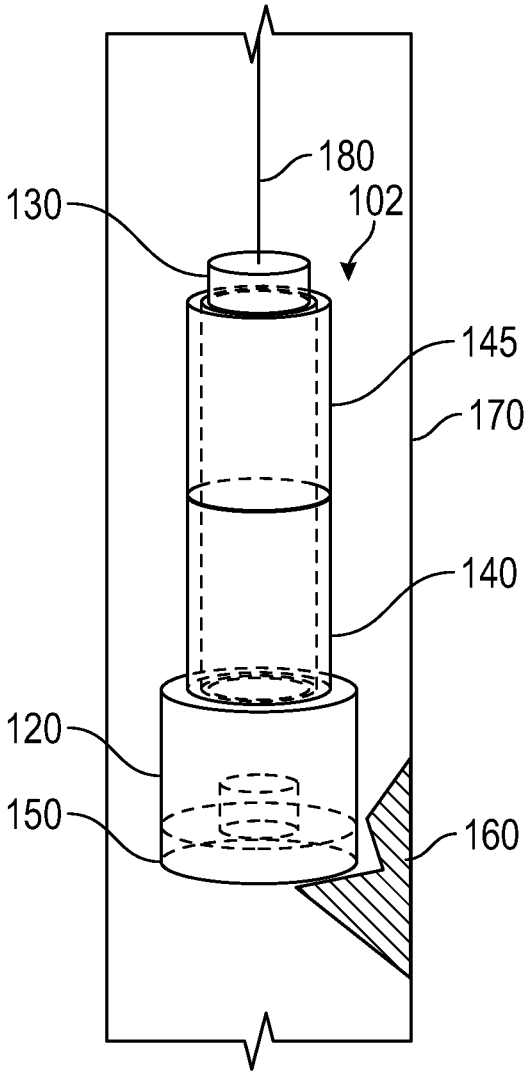

FIG. 4D shows a transient configuration of the apparatus 110 according to one or more embodiments. FIG. 4D shows the advancement of the apparatus 110 after the inner sleeve 145 interacts with the obstruction 160. That is, FIG. 4D shows the inner sleeve 145 moving between the third position and the fourth position. In accordance with one or more embodiments, when the inner sleeve 145 collides with the obstruction 160, a force of the impact created by the interaction breaks the attachment of the inner sleeve 145 to the second cylindrical rod 120. Accordingly, the inner sleeve 145 is pushed away from the second cylindrical rod 120.

The inner sleeve 145 moves away from the obstruction 160 due to the force of the impact from the collision. At the same time, the inner sleeve 145 starts contracting once the inner sleeve 145 is allowed to contract around a smaller object, i.e., the first cylindrical rod 130. In accordance with one or more embodiments, the released portion of the inner sleeve 145 (the upper portion in FIG. 4B) contracts first creating a truncated cone shape.

FIG. 4E shows another configuration of the apparatus 110 after the interaction with the obstruction 160 in accordance with one or more embodiments. The configuration shown in FIG. 4E presents a transient or a final position of the inner sleeve 145, depending on the degree of the shifting of the inner sleeve 145 from the second cylindrical rod 120. If the force of the impact from the collision does not provide enough energy to the inner sleeve 145 to move past the outer sleeve 140 in the second position, then the inner sleeve 145 stops moving. In this scenario, the inner sleeve 145 is disposed concentrically around the outer sleeve 140 and the first cylindrical rod 130.

In other embodiments, the inner sleeve 145 may continue shifting away from the second cylindrical rod 120 if there is ample force applied to the inner sleeve 145 from the collision. As such, the inner sleeve 145 may move past the outer sleeve 140, located in the second position, after the interaction with the obstruction 160.

FIG. 4F shows the configuration of the apparatus 110 if the force of the impact pushes the inner sleeve 145 past the outer sleeve 140 located in the second position. In this scenario, the inner sleeve 145 may only be disposed concentrically around the first cylindrical rod 130.

As described previously, the system 100 may detect the presence and/or approximate location of the obstruction 160 using various methods. In addition, the system 100 may estimate the size of the obstruction 160 by identifying the number of shifted sleeves. The size of the obstruction 160 determines how many sleeves collide with the obstruction 160 and move from the second cylindrical rod 120 to the first cylindrical rod 130, in accordance with one or more embodiments.

Figure 5A:
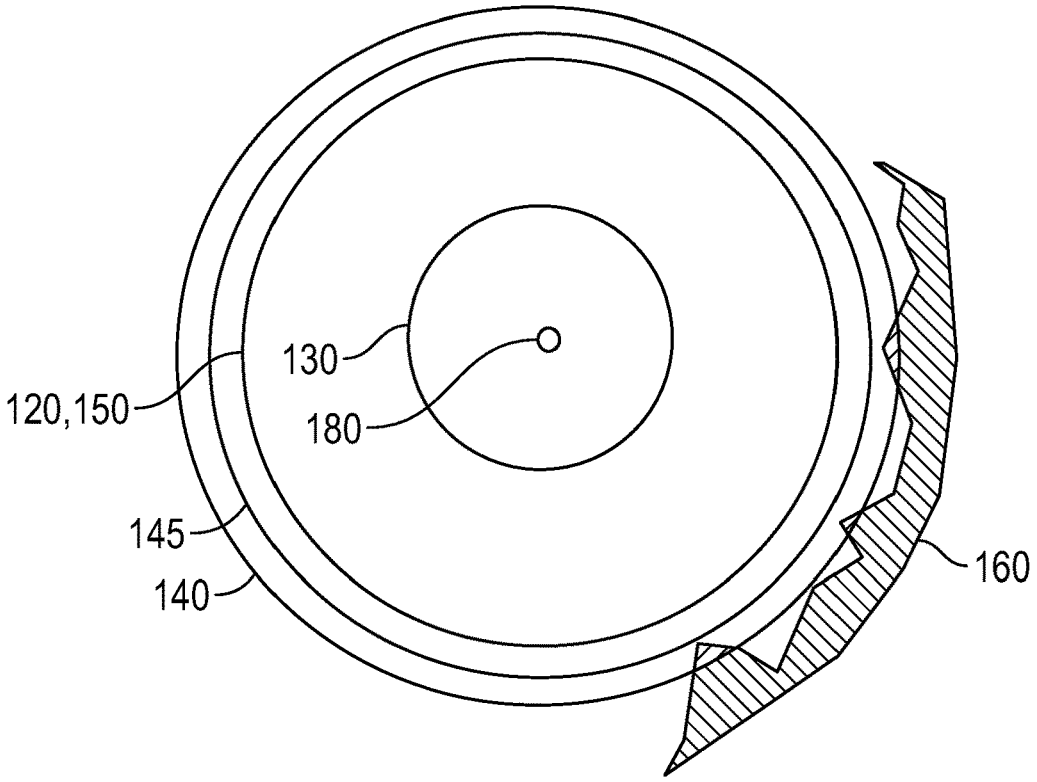
FIGS. 5A and 5B show top views of an apparatus in accordance with one or more embodiments.
Figure 5B:
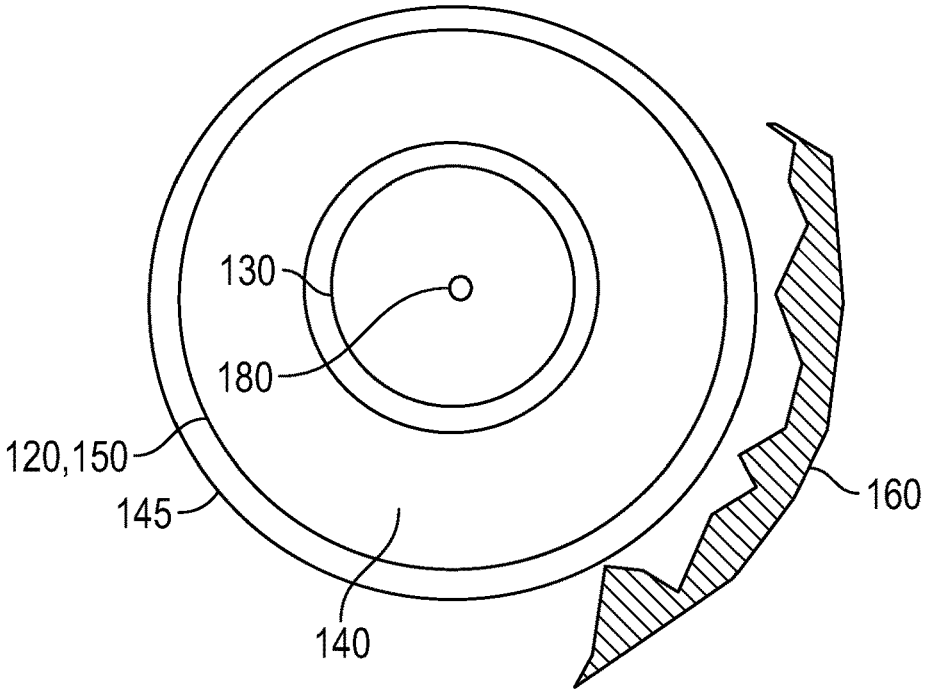

The sequence of events discussed in detail in relation to FIGS. 3A to 3D is shown in top views of the apparatus 110, depicted in FIGS. 5A and 5B in accordance with one or more embodiments.

FIG. 5A illustrates the configuration of the apparatus 110 before the collision with the obstruction 160. The apparatus 110 includes the outer sleeve 140 and the inner sleeve 145 disposed around the second cylindrical rod 120. As is clear from FIG. 5A, the obstruction 160 is sized such that the obstruction 160 does not reach the outer surface of the inner sleeve 145. However, the obstruction 160 does extend to the outer surface of the outer sleeve 140. Accordingly, the collision with the obstruction 160 impacts only the outer sleeve 140.

As a result, the outer sleeve 140 is released from the inner sleeve 145 and shifts away from the second cylindrical rod 120. The outer sleeve 140 shifts and contracts to be disposed around the first cylindrical rod 130 in accordance with one or more embodiments. As shown in FIG. 5B, the diameter of the apparatus 110 decreases by the thickness of the shifted outer sleeve 140.

The sequence of events discussed in detail in relation to FIGS. 4A to 4F is summarized in top views of the apparatus 110, as depicted in FIGS. 6A to 6D in accordance with one or more embodiments.

Figure 6A:
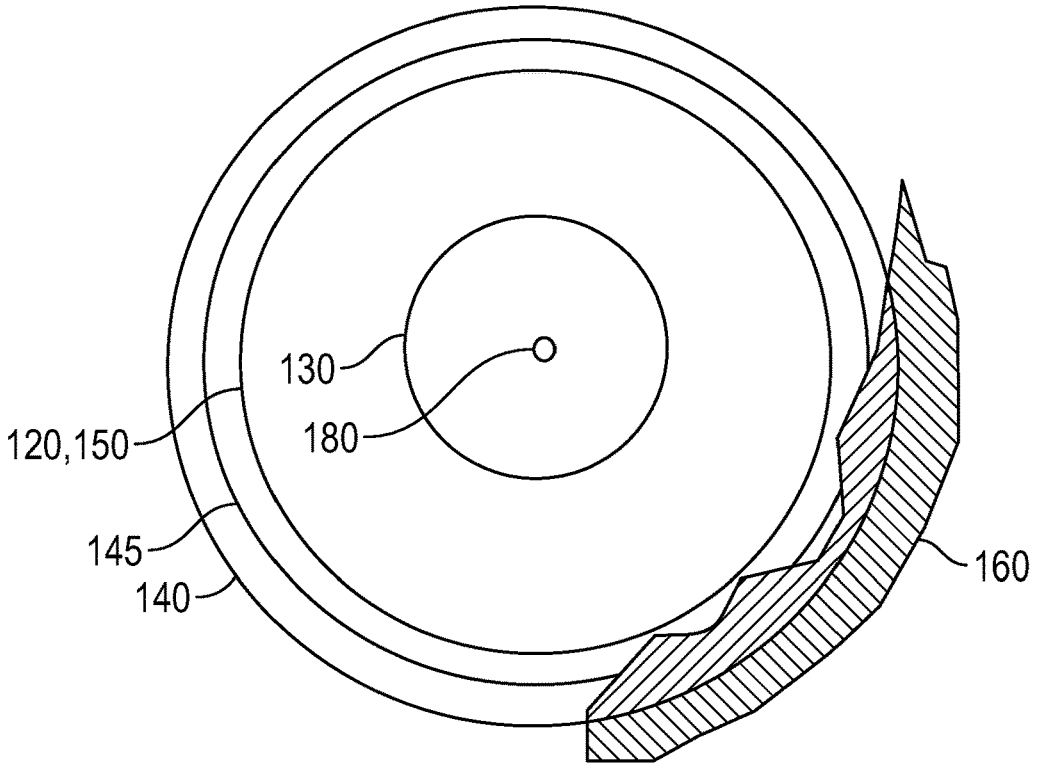
FIGS. 6A to 6D show top views of an apparatus in accordance with one or more embodiments.

FIG. 6A illustrates the configuration of the apparatus 110 before the collision with the obstruction 160. The apparatus 110 includes the outer sleeve 140 and the inner sleeve 145 disposed around the second cylindrical rod 120. The obstruction 160 is sized such that the obstruction 160 extends to both the outer surface of the inner sleeve 145 and the outer surface of the outer sleeve 140.

Figure 6B:
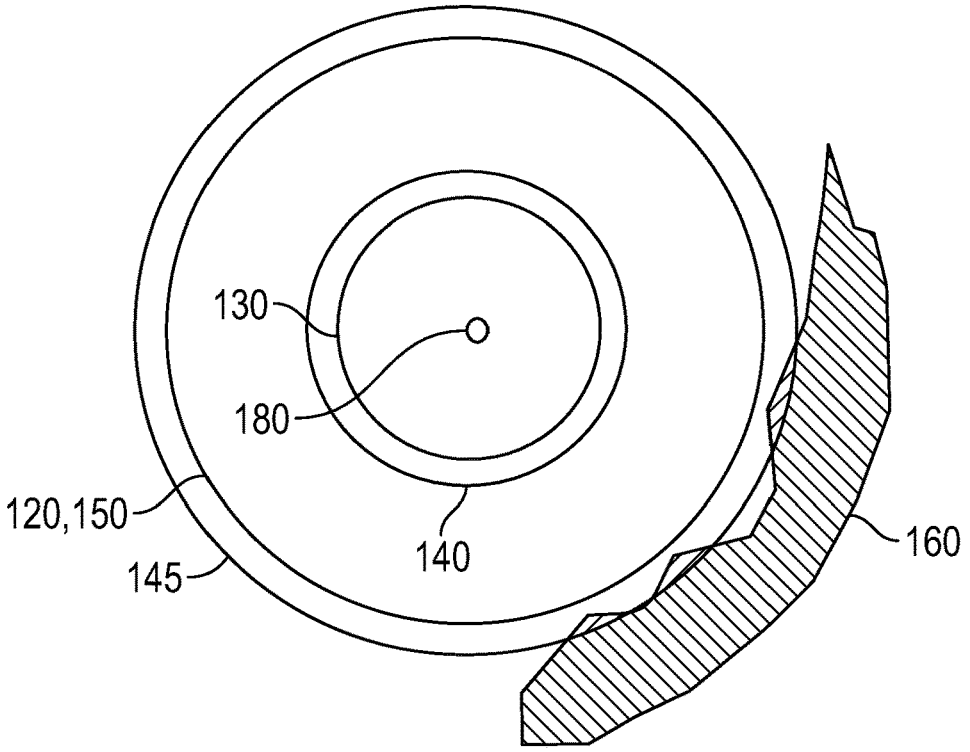

Accordingly, the obstruction 160 collides with the outer sleeve 140, resulting in the displacement of the outer sleeve 140, as shown in FIG. 6B. The outer sleeve 140 is released from the inner sleeve 145 and moves away from the second cylindrical rod 120. The outer sleeve 140 shifts and contracts to be disposed around the first cylindrical rod 130 in accordance with one or more embodiments.

Figure 6C:
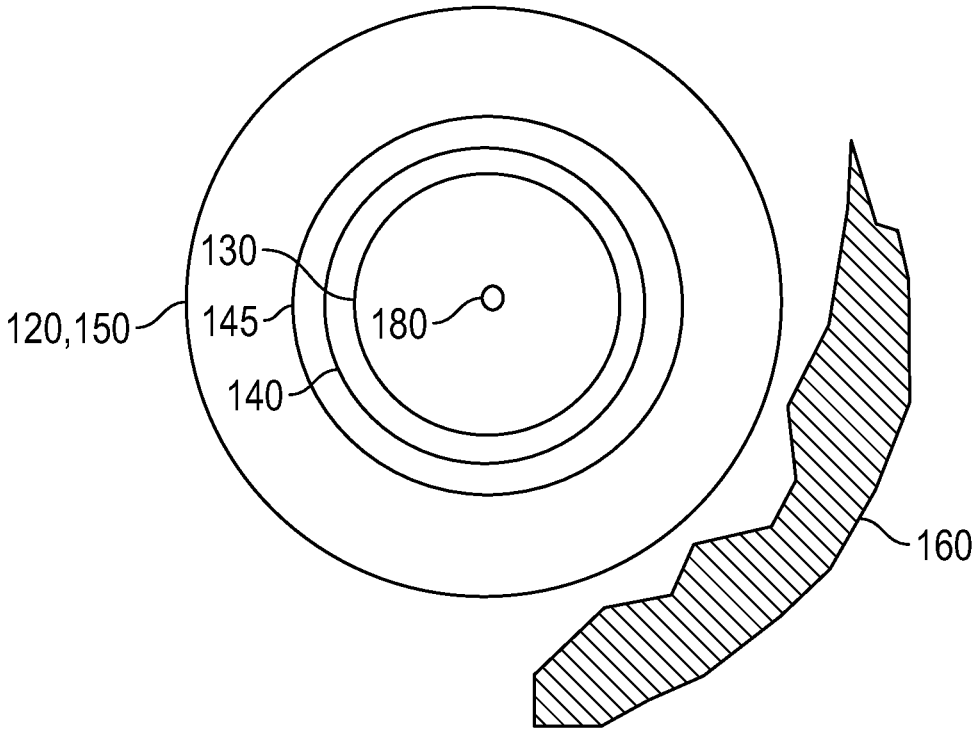

In accordance with one or more embodiments, the obstruction 160 also hits the inner sleeve 145. The inner sleeve 145 receives the force of the impact. The force of impact releases the inner sleeve 145 from the second cylindrical rod 120. The force of impact also causes the inner sleeve 145 to move away from the second cylindrical rod 120, as shown in FIG. 6C. The inner sleeve 145 shifts and contracts to be disposed around the outer sleeve 140. Based on the size of the force of impact, the inner sleeve 145 may stay disposed around the outer sleeve 140 or the inner sleeve 145 may shift further to be disposed directly around the first cylindrical rod (130).

Figure 6D:
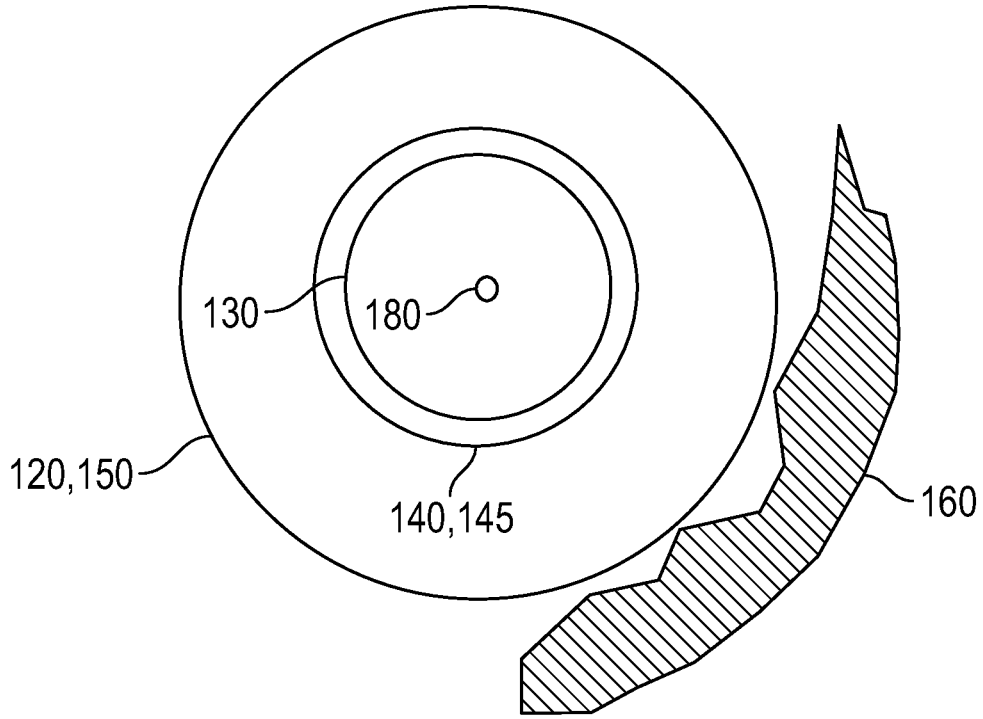

As is clear from FIG. 6D, the size of the apparatus 110 decreases by the thickness of the shifted outer sleeve 140 and inner sleeve 145.

The previous discussions about the sequence of events shown in FIGS. 6A to 6D apply to the sequence of events illustrated in FIGS. 7A to 7D. However, the obstruction 160 shown in FIGS. 7A to 7D extends further into the conduit 102 and creates a greater blockage in the tubular 170 than the obstruction 160 shown in FIGS. 6A to 6D.

Figure 7A:
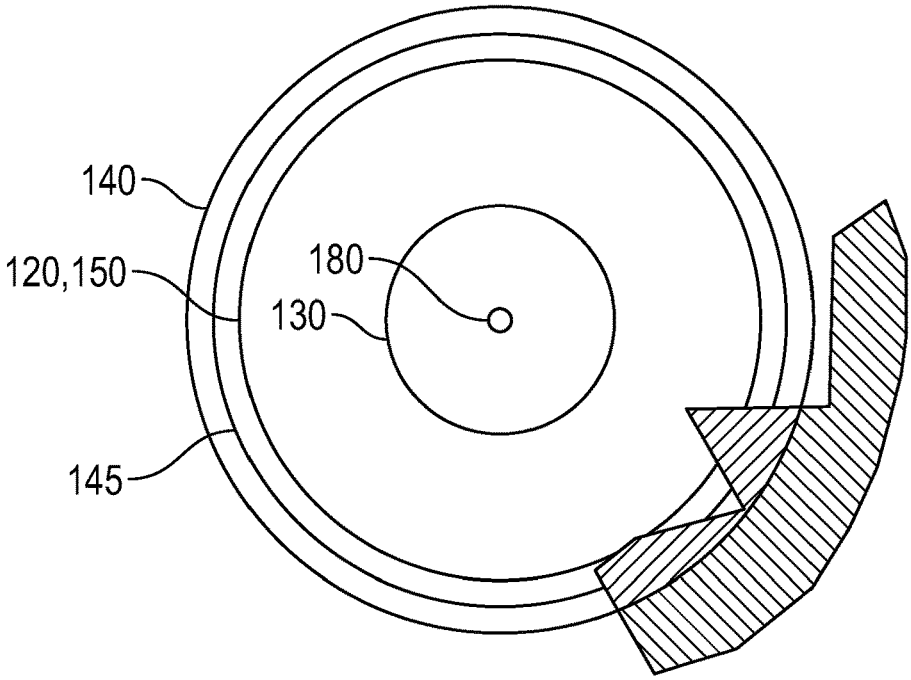
FIGS. 7A to 7D show top views of an apparatus in accordance with one or more embodiments.

FIG. 7A to 7D show top views of the apparatus 110, as depicted in accordance with one or more embodiments. Specifically, FIG. 7A illustrates the configuration of the apparatus 110 before the collision with the obstruction 160. The obstruction 160 extends past the outer surface of the outer sleeve 140, the outer surface of the inner sleeve 145, and the outer surface of the second cylindrical rod 120/impression block 150.

Figure 7B:
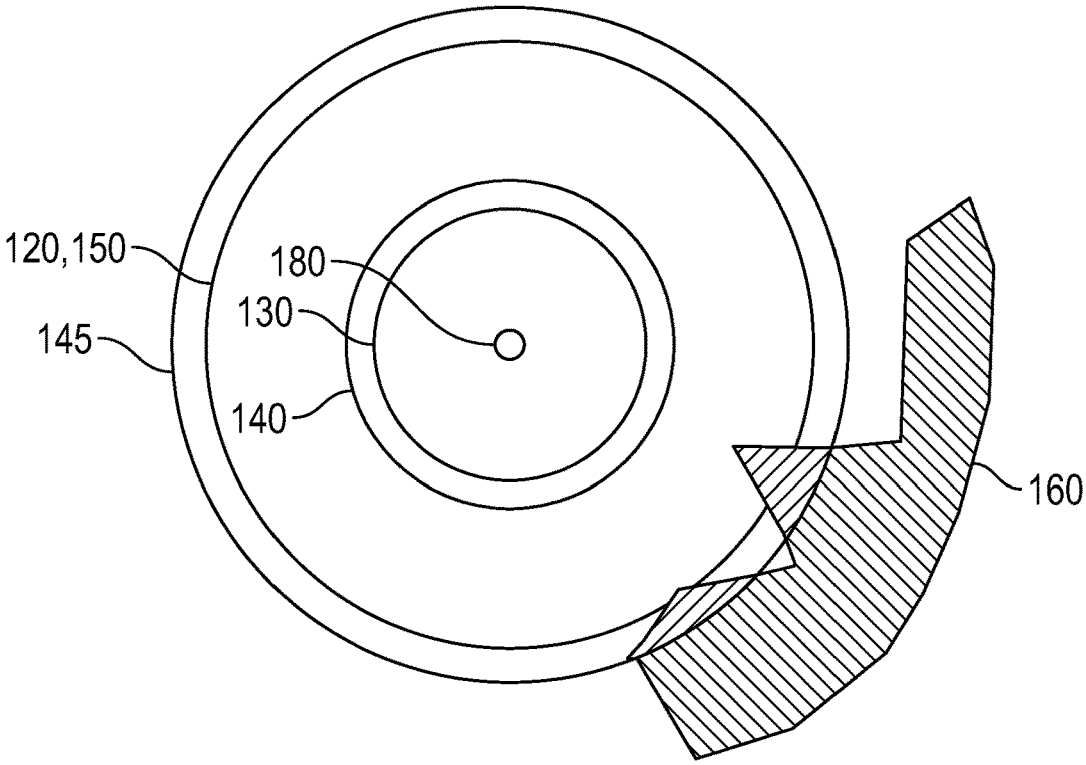
Figure 7C:
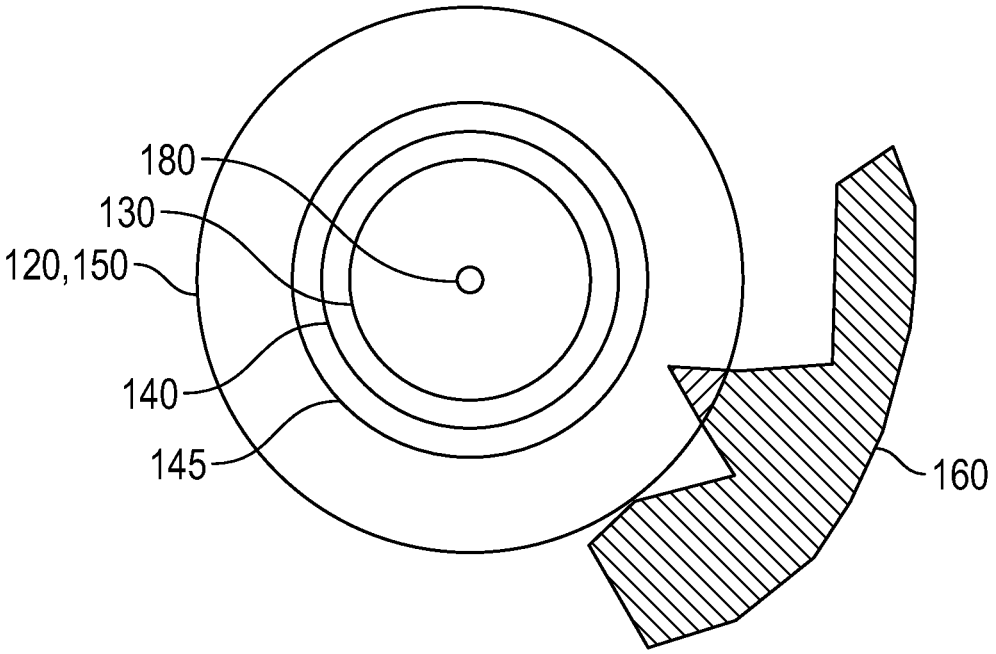

As such, the obstruction 160 interacts with the outer sleeve 140, the inner sleeve 45, and the impression block 150, resulting in the displacement of both the outer sleeve 140, as shown in FIG. 7B, and the inner sleeve 145, as shown in FIG. 7C. Further, the impression block 150 is able to hit a portion of the obstruction 160 and obtain an impression of the portion of the obstruction 160.

As illustrated in FIG. 7B, the outer sleeve 140 is released from the inner sleeve 145 and moves away from the second cylindrical rod 120 in accordance with one or more embodiments.

In accordance with one or more embodiments, the obstruction 160 also hits the inner sleeve 145. The force of impact also causes the inner sleeve 145 to move away from the second cylindrical rod 120, as shown in FIG. 7C. The inner sleeve 145 shifts and contracts to be disposed around the outer sleeve 140. Based on the size of the force of impact, the inner sleeve 145 may stay disposed around the outer sleeve 140.

Figure 7D:
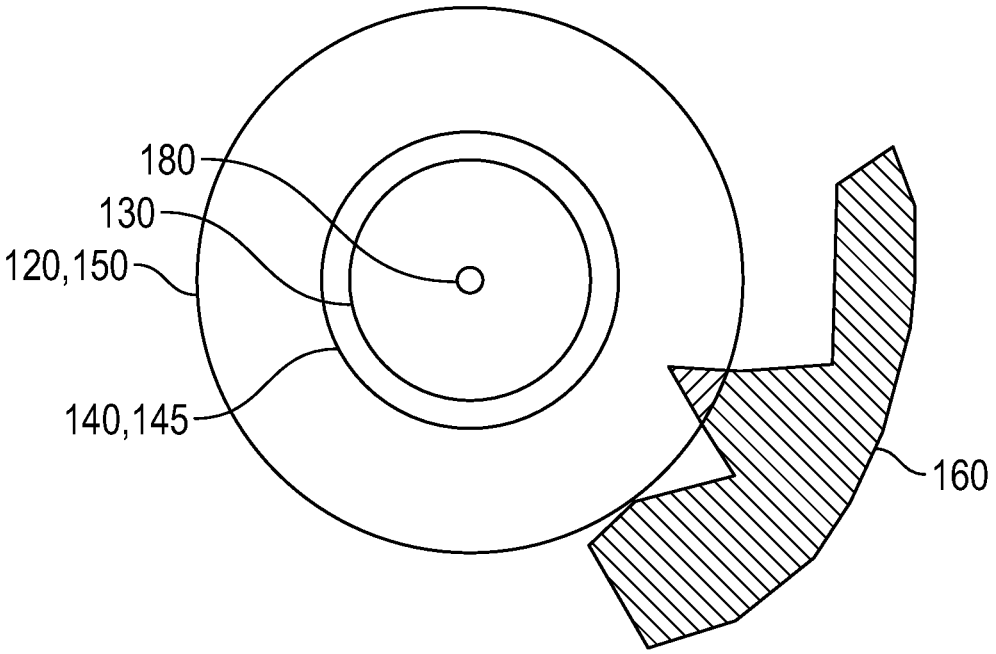

In accordance with one or more embodiments and as shown in FIG. 7D, the inner sleeve 145 shifts further away from the second cylindrical rod 120 to be disposed directly around the first cylindrical rod 130. In accordance with one or more embodiments, the outer diameter/circumference of the apparatus 110 decreases by the thickness of the shifted outer sleeve 140 and inner sleeve 145.

In accordance with one or more embodiments, as illustrated in FIG. 7D, the apparatus 110 cannot bypass the obstruction 160 if the obstruction 160 extends further to the outer surface of the second cylindrical rod 120. The system 100 may identify the location of the obstruction 160 by the contraction and shifting of the outer sleeve 140 and the inner sleeve 140. The system 100 may also reveal that the obstruction 160 at least extends to the outer surface of the second cylindrical rod 120 due to the inability of the apparatus 110 to advance further into the tubular 170.

Figure 8:
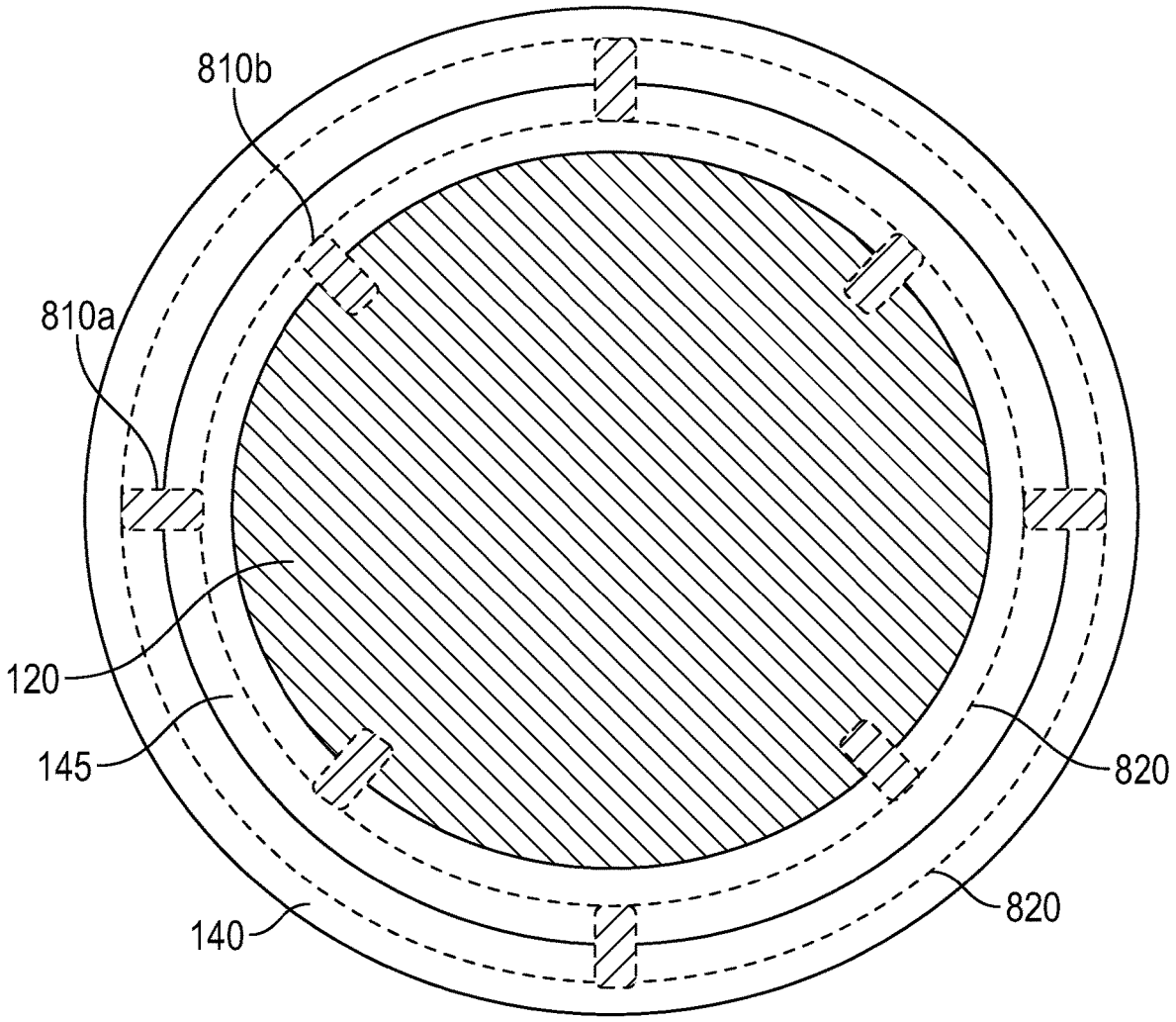
FIG. 8 shows a horizontal cross-section view of an apparatus in accordance with one or more embodiments.

FIG. 8 shows a horizontal cross-section view of the apparatus 110 before the collision with the obstruction 160 in accordance with one or more embodiments. FIG. 8 depicts the arrangement of the apparatus 110 dissected at the level of L-L' in FIG. 2. The apparatus 110 incorporates stretchable elements 820 as indicated by dashed lines. At least one stretchable element 820 is embedded in the inner sleeve 145, and at least one stretchable element 820 is embedded in the outer sleeve 140. In accordance with one or more embodiments, the stretchable elements 820 shown in FIG. 8 may be embedded coils/springs or elastic bands.

In accordance with one or more embodiments, the outer sleeve 140 and the inner sleeve 145 are connected to one another by one or more pins 810*a*. In further embodiments, the inner sleeve 145 is connected to the second cylindrical rod 120 by one or more pins 810*b*. The pins 810*a*, 810*b* may be shear pins 810*a*, 810*b* that are designed to break, or shear, when a predetermined pressure is seen across the pins 810*a*, 810*b*. The predetermined pressure may be applied by the interaction between the apparatus 110 and the obstruction 160. In addition to, or in alternative to the plurality of pins 810*a*, 810*b*, other types of instruments that have the ability to break off may be used for the connection of the outer sleeve 140 to the inner sleeve 145 and the connection of the inner sleeve 145 to the second cylindrical rod 120.

FIGS. 9A to 9D show schematic views of a stretchable cylindrical sleeve in accordance with one or more embodiments. The sleeve shown in FIGS. 9A to 9D may be the inner sleeve 145 or the outer sleeve 140 as outlined above. The sleeve shown in FIGS. 9A to 9D is shown not installed as part of the apparatus 110.

FIGS. 9A to 9D further show the sleeve having a plurality of cutters 910*a*-910*e*. In accordance with one or more embodiments, the cutters 910*a*-910*e* are a sharp edge on an end of the sleeve. The cutters 910*a*-910*e* may be located on the downhole end of the sleeve when the sleeve is installed as part of the apparatus 110 and deployed in the well 104. In one example and as shown in FIGS. 9A to 9D, the sleeve is comprised of a plurality of panels 930*a*-930*e* that are connected to one another by stretchable elements 820.

FIGS. 9A to 9D show two different configurations of stretchable elements 820; however, these configurations are not meant to be limiting and the sleeve may have any type and any configuration of stretchable elements without departing from the scope of the disclosure herein.

Figure 9A:
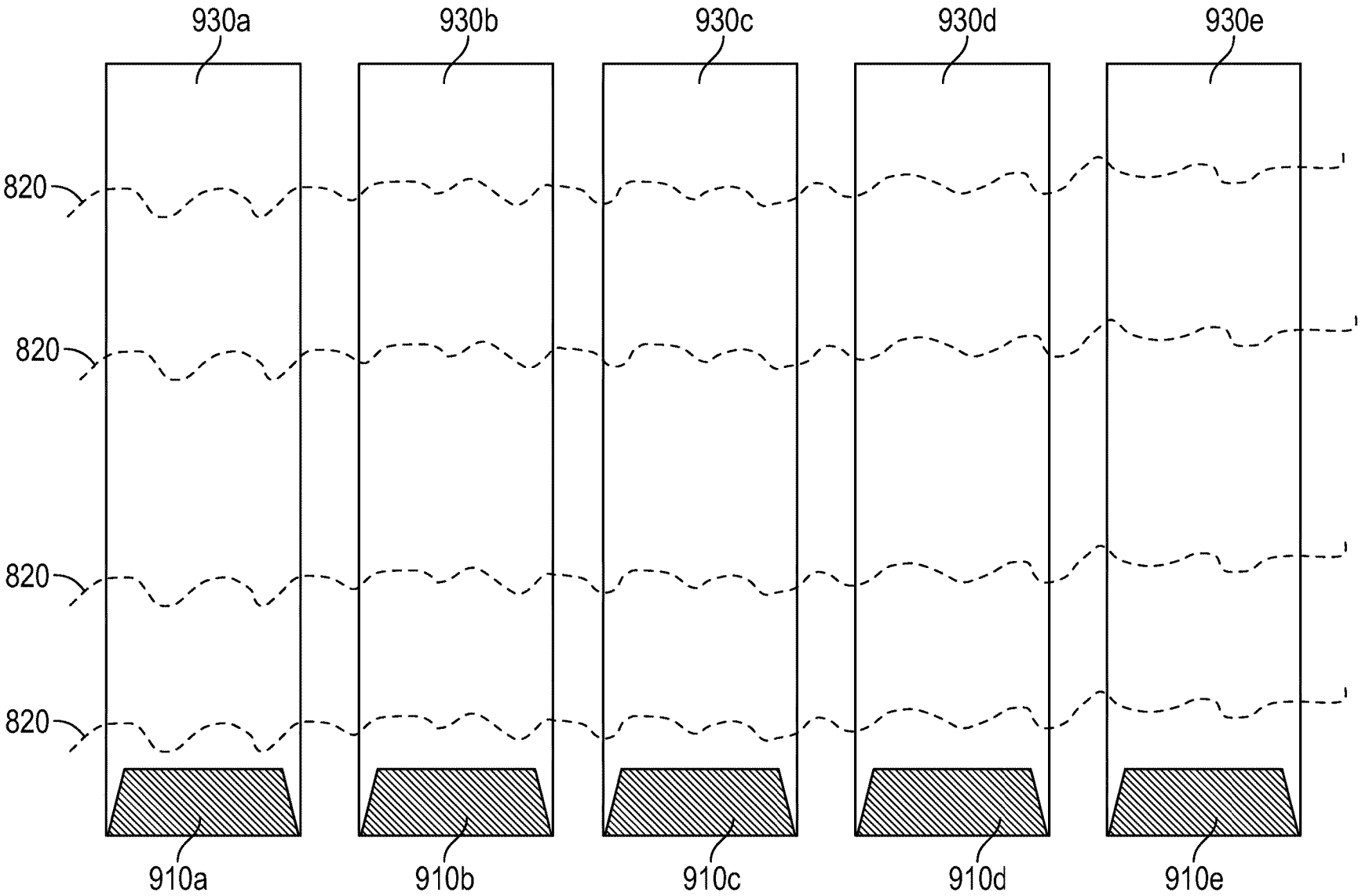
FIGS. 9A to 9D show schematic views of a cylindrical sleeve in accordance with one or more embodiments.
Figure 9B:
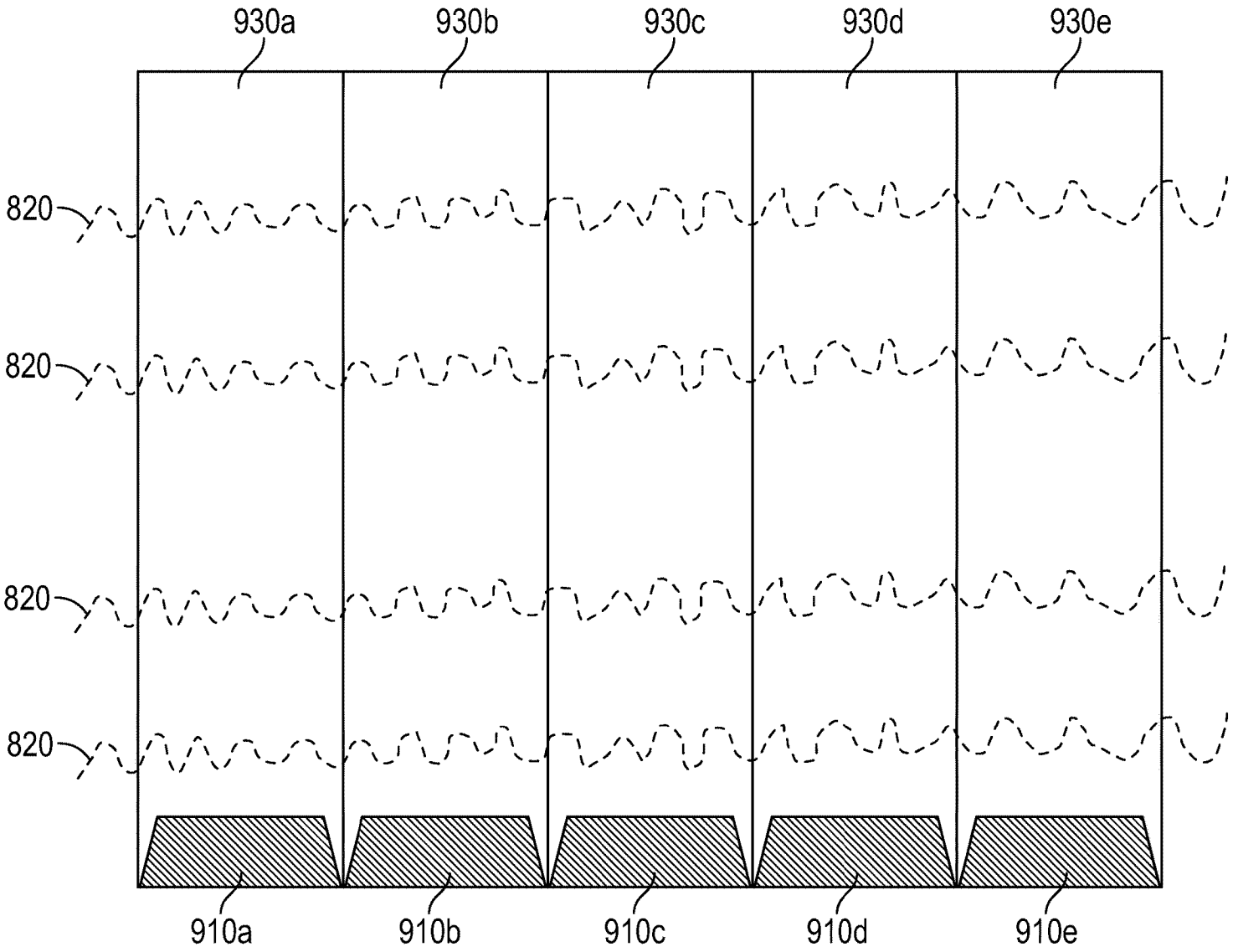
Figure 9C:
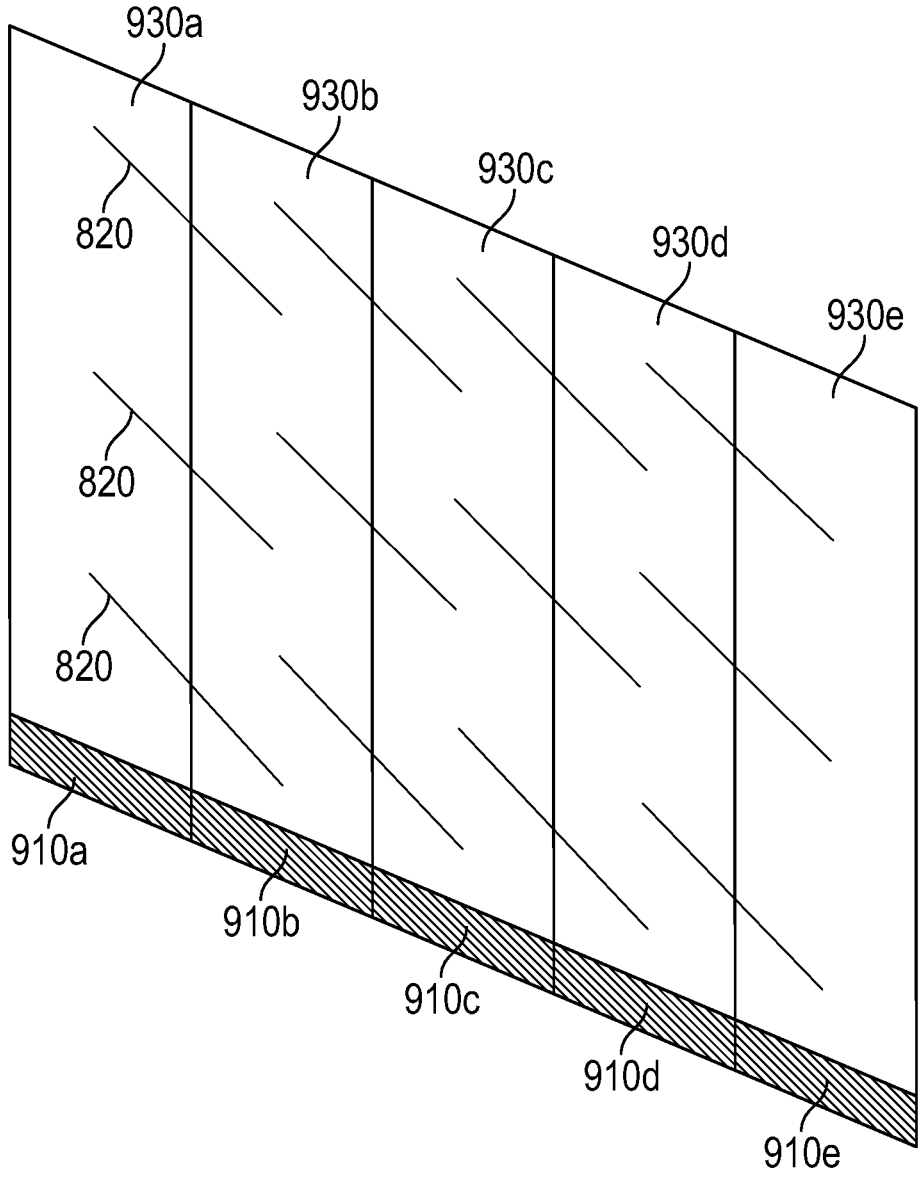

The stretchable elements 820 shown in FIGS. 9A and 9B are stretchable elements 820 that extend through all five panels. The stretchable elements 820 shown in FIGS. 9C and 9D are diagonally aligned stretchable elements 820. Each diagonally aligned stretchable element only connects two neighboring panels 930*a*-930*e* rather than extending across all five panels 930*a*-930*e*.

FIG. 9A shows the sleeve in a state where an external force to stretch the sleeve is applied. In accordance with one or more embodiments, the extended sleeve may have a sufficient circumference to be disposed around the second cylindrical rod 120. The panels 930*a*-930*e* may be made of metal or other durable materials, and each panel 930*a*-930*e* may lack foldable parts. In such implementations, each panel 930*a*-930*e* is separated from neighboring panels when stretched, as shown in this example. However, the panels 930*a*-930*e* may include extendable pleated sheets, which provide connections to neighboring panels even in a stretched position.

FIG. 9B shows the sleeve, as described in FIG. 9A, in a baseline state where an external force to stretch the sleeve is not applied in accordance with one or more embodiments. The stretchable element 820 are shown in a relaxed state. In the relaxed state, the stretchable elements 820 and hold the panels 930*a*-930*e* closer to one another when compared to the stretchable elements 820 being in the stretched state shown in FIG. 9A. In accordance with one or more embodiments, the stretchable elements 820 may be in the relaxed state when the attachment to an underlay (e.g., pins 810) is broken.

Turning to FIG. 9C, the stretchable elements 820 shown are diagonally aligned stretchable elements 820. Each diagonally aligned stretchable element 820 connects two neighboring panels 930*a*-930*e*. In accordance with one or more embodiments, the circumference of the sleeve lengthens if an external force stretches the stretchable elements 820. As a result, the sleeve may be disposed around the second cylindrical rod 120. FIG. 9C shows the sleeve in an extended or stretched state. Since the stretchable elements 820 run diagonally in relation to each panel 930*a*-930*e*, each panel 930*a*-930*e* may be touching its neighboring panels 930*a*-930*e* when in the stretched position.

Figure 9D:
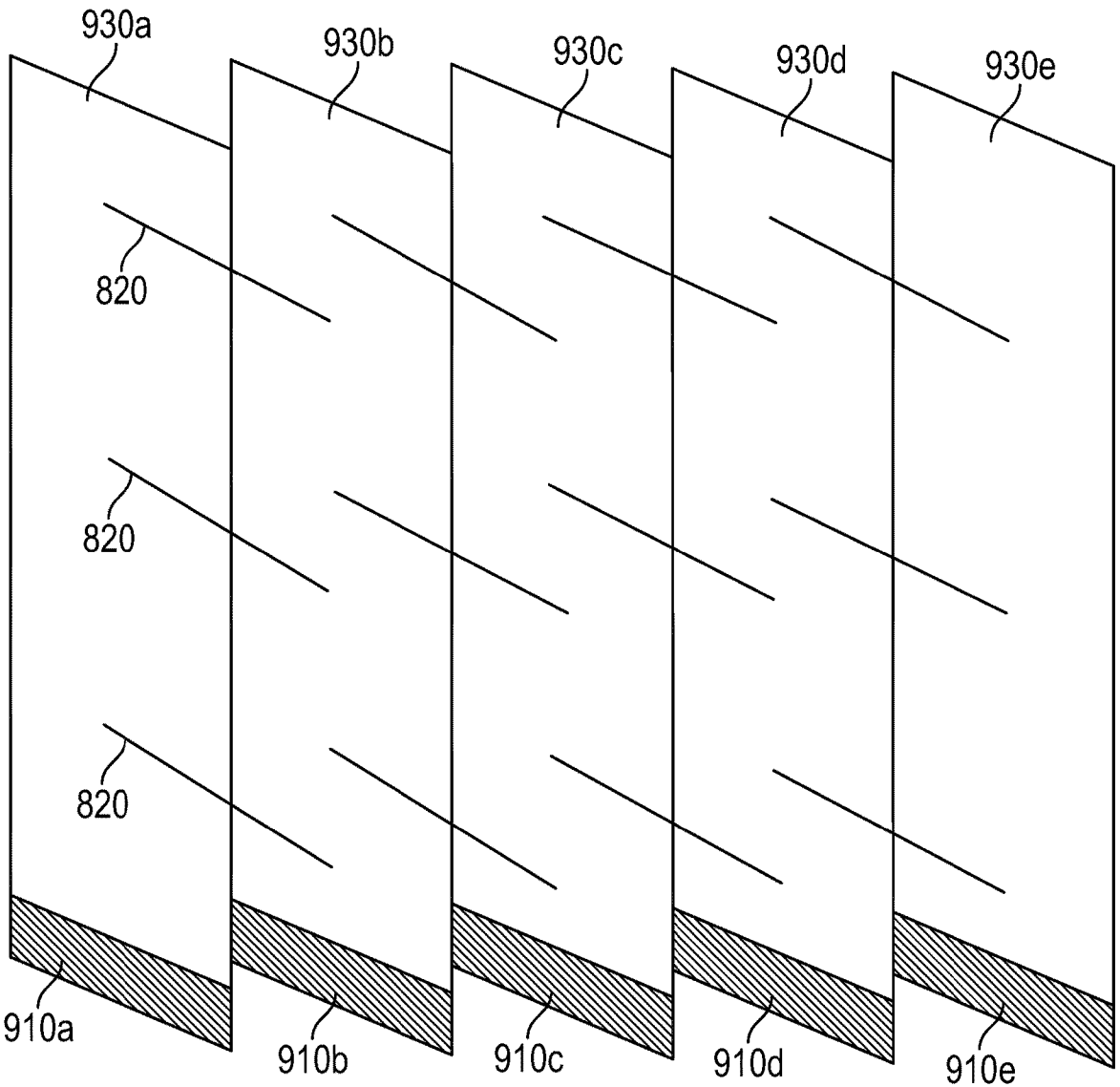

FIG. 9D shows the sleeve in a baseline state where an external force to stretch the sleeve is not applied in accordance with one or more embodiments. In further embodiments, the stretchable elements 820 revert to a relaxed position, causing the panels 930*a*-930*e* to move closer to one another, when the attachment to an underlay (e.g., pins 810) is broken.

Figure 10:
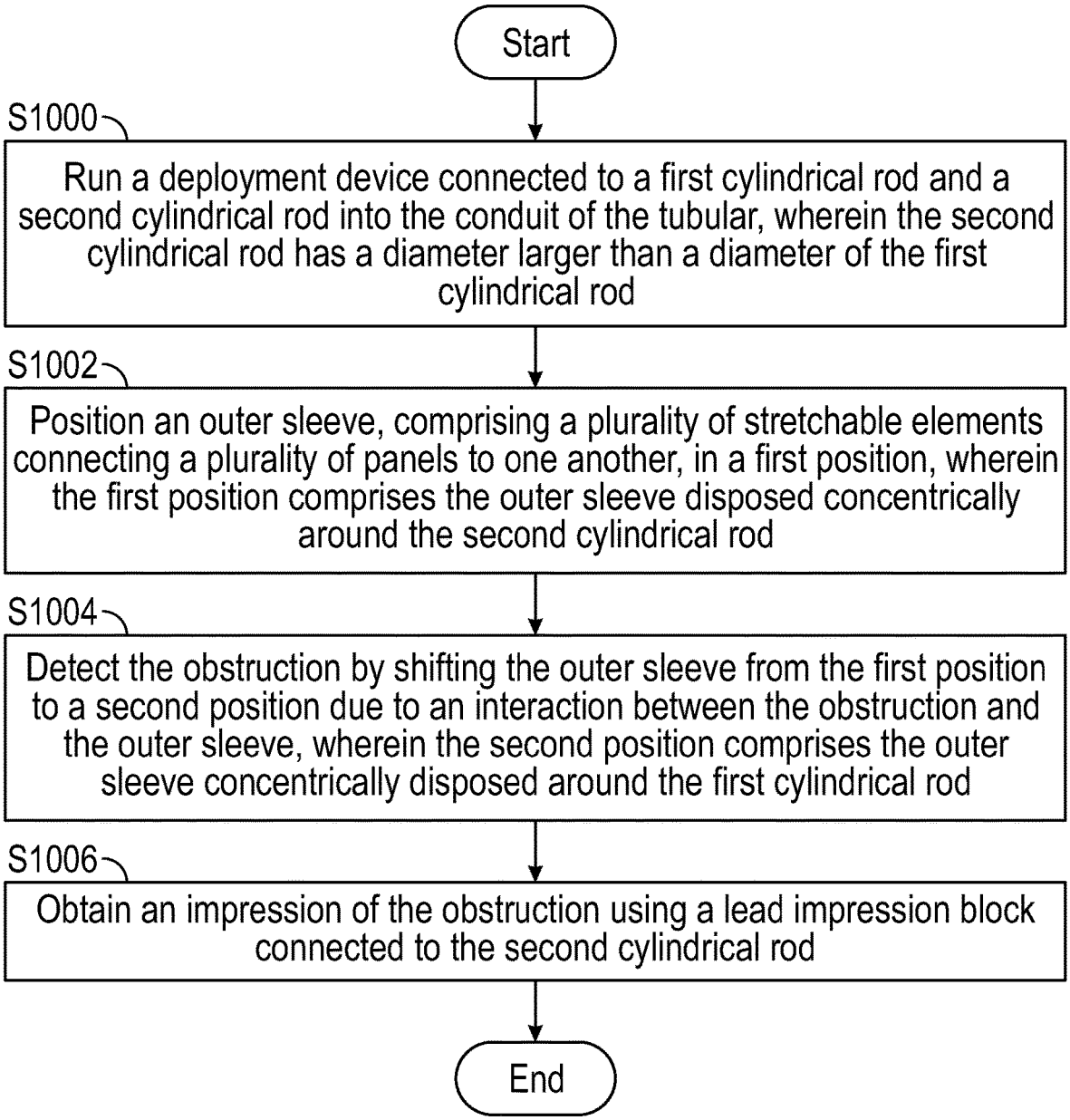
FIG. 10 shows a flowchart in accordance with one or more embodiments.

FIG. 10 shows a flowchart in accordance with one or more embodiments. The flowchart outlines a method for evaluating an obstruction 160 in a conduit 102 of a tubular 170. While the various blocks in FIG. 10 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S1000, a deployment device 180 connected to a first cylindrical rod 130 and a second cylindrical rod 120 is run into the conduit 102 of the tubular 170. The second cylindrical rod 120 has a diameter larger than a diameter of the first cylindrical rod 130. In accordance with one or more embodiments, one end of the first cylindrical rod 130 is connected to the deployment device 180 and the other end of the first cylindrical rod 130 is connected to the second cylindrical rod 120.

In accordance with one or more embodiments, the deployment device 180 is wireline or slickline. The tubular 170 may be disposed in a well 104. The tubular 170 may have an obstruction 160 that reduces the accessible inner diameter of the tubular 170. In further embodiments, the deployment device 180 is running the first cylindrical rod 130 and a second cylindrical rod 120 through the conduit 102 of the tubular 170 to determine the accessible inner diameter of the tubular 170.

In S1002, an outer sleeve 140, comprising a plurality of stretchable elements 820 connecting a plurality of panels 930*a*-930*e* to one another, is positioned in a first position. The first position includes the outer sleeve 140 disposed concentrically around the second cylindrical rod 120.

In accordance with one or more embodiments, an inner sleeve 145, comprising a plurality of stretchable elements 820 connecting a plurality of panels 930*a*-930*e* to one another, is positioned in a third position. The third position includes the inner sleeve 145 disposed concentrically around the second cylindrical rod 120 between the outer sleeve 140 and the second cylindrical rod 120.

In further embodiments, the inner sleeve 145 is movably connected to the second cylindrical rod 120 using one or more pins 810*a*, 810*b*, and the outer sleeve 140 is movably connected to the inner sleeve 145 also using one or more pins 810*a*, 810*b*. The pins 810*a*, 810*b* may be shear pins 810*a*, 810*b* in accordance with one or more embodiments. Further, the stretchable elements 820 connecting the panels 930*a*-930*e* are used to change the diameter and circumference of the inner sleeve 145 and the outer sleeve 140 based on the size of the underlay.

In S1004, the obstruction 160 is detected by shifting the outer sleeve 140 from the first position to a second position due to an interaction between the obstruction 160 and the outer sleeve 140. The second position includes the outer sleeve 140 concentrically disposed around the first cylindrical rod 130.

In accordance with one or more embodiments, the obstruction 160 is also detected by shifting the inner sleeve 145 from the third position to a fourth position due to an interaction between the inner sleeve 145 and the obstruction 160. The fourth position includes the inner sleeve 145 concentrically disposed around the first cylindrical rod (130). In the fourth position, the inner sleeve 145 may be directly disposed around the first cylindrical rod 130, or the inner sleeve 145 may be disposed around the first cylindrical rod 130 and the outer sleeve 140.

In further embodiments, a size of the obstruction 160 is determined based on the outer sleeve 140 shifting from the first position to the second position. In other embodiments, the size of the obstruction 160 is determined based on the outer sleeve 140 shifting from the first position to the second position and the inner sleeve 145 being retained in the third position. Alternatively, the size of the obstruction 160 is determined based on the outer sleeve 140 shifting from the first position to the second position and the inner sleeve 145 shifting form the third position to the fourth position. In other words, the accessible inner diameter of the tubular 170 may be determined based on the number of sleeves moved off of the second cylindrical rod 120 after the drifting operation is completed.

In accordance with one or more embodiments, the outer sleeve 140 may be shifted from the first position to the second position by shearing the pins 810*a*, 810*b* that connect the outer sleeve 140 to the inner sleeve 145. The pins 810*a*, 810*b* may be sheared using a force of impact created by the interaction between the outer sleeve 140 and the obstruction 160. Further, the inner sleeve 145 may be shifted from the third position to the fourth position by shearing the pins 810*a*, 810*b* that connect the inner sleeve 145 to the second cylindrical rod 120. The pins 810*a*, 810*b* may be sheared using a force of impact created by the interaction between the inner sleeve 145 and the obstruction 160.

In further embodiments, the inner sleeve 145 and the outer sleeve 140 are equipped with sharp edges, or cutters 910*a*-910*e*, located on the downhole portion of the sleeve. When the apparatus 110 is being run inside the conduit 102 for the tubular 170 and the obstruction 160 is encountered, the cutters 910*a*-10*e* may be used to remove the obstruction 160 from an inner wall of the tubular 170.

In this scenario, the obstruction 160 may be a weaker obstruction, such as scale, and only a small force is required to remove the obstruction 160 from the wall of the tubular 170. In particular, the force required to remove the obstruction 160 may be less than the force required to shear the pins 810*a*, 810*b* connecting the sleeves to their underlays. Thus, the obstruction 160 may be removed while retaining the size of the apparatus 110.

In S1006, an impression of the obstruction 160 is obtained using an impression block 150 connected to the second cylindrical rod 120. The impression block 150 may be a lead impression block 150 and may be connected to an inner surface of the second cylindrical rod 120. The impression block 150 and the second cylindrical rod 120 may be connected to one another using any connection known in the art, such as a welded connection, a threaded connection, etc. In other embodiments, the impression block 150 and the second cylindrical rod 120 may be machined as one component.

The apparatus 110 may obtain an impression of the obstruction 160 with the impression block 150 and use the impression to identify the nature of the obstruction 160. In accordance with one or more embodiments, the impression block 150 may interact with the obstruction 160 when or after the outer sleeve 140 shifts from the first position to the second position and/or the inner sleeve 145 shifts from the third position to a fourth position.

In accordance with one or more embodiments, the impression block 150 may provide evidence as to the cause of the obstruction 160 by identifying the shape of the obstruction 160. For example, an emerged deformation in the tubular 170 may suggest the presence of collapsed rock wall in the wellbore 106. In further embodiments, the impression block 150 may provide a visual of the obstruction 160 which allows an operator to determine what tool is required to remove the obstruction 160 from the tubular 170.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. An apparatus for deployment in a conduit of a tubular having an obstruction, the apparatus comprising:

a first cylindrical rod connected to a deployment device configured to deploy the first cylindrical rod into the conduit of the tubular;

a second cylindrical rod connected to the first cylindrical rod, wherein the second cylindrical rod has a diameter larger than a diameter of the first cylindrical rod;

an outer sleeve movable between a first position and a second position, wherein the first position comprises the outer sleeve concentrically disposed around the second cylindrical rod and the second position comprises the outer sleeve concentrically disposed around the first cylindrical rod after an interaction between the outer sleeve and the obstruction, the outer sleeve comprising a plurality of panels connected to one another by a plurality of stretchable elements; and an impression block connected to the second cylindrical rod, wherein the impression block is configured to obtain an impression of the obstruction.

2. The apparatus of claim 1, further comprising:

an inner sleeve movable between a third position and a fourth position, wherein the third position comprises the inner sleeve concentrically disposed beneath the outer sleeve and around the second cylindrical rod and the fourth position comprises the inner sleeve concentrically disposed around the first cylindrical rod, the inner sleeve comprising a plurality of panels connected to one another by a plurality of stretchable elements.

3. The apparatus of claim 2, wherein the outer sleeve is movably connected to the inner sleeve via pins configured to shear due to a force of impact from the interaction between the outer sleeve and the obstruction.

4. The apparatus of claim 3, wherein the inner sleeve is movably connected to the second cylindrical rod via pins configured to shear due to a force of impact from an interaction between the inner sleeve and the obstruction.

5. The apparatus of claim 2, wherein an impression of the obstruction is obtained when the outer sleeve shifts from the first position to the second position and when the inner sleeve shifts from the third position to the fourth position.

6. The apparatus of claim 1, wherein an impression of the obstruction is obtained when the outer sleeve shifts from the first position to the second position.

7. A method for evaluating an obstruction in a conduit of a tubular, comprising:

running a deployment device connected to a first cylindrical rod and a second cylindrical rod into the conduit of the tubular, wherein the second cylindrical rod has a diameter larger than a diameter of the first cylindrical rod;

positioning an outer sleeve, comprising a plurality of stretchable elements connecting a plurality of panels to one another, in a first position, wherein the first position comprises the outer sleeve disposed concentrically around the second cylindrical rod;

detecting the obstruction by shifting the outer sleeve from the first position to a second position due to an interaction between the obstruction and the outer sleeve, wherein the second position comprises the outer sleeve concentrically disposed around the first cylindrical rod; and obtaining an impression of the obstruction using an impression block connected to the second cylindrical rod.

8. The method of claim 7, further comprising:

determining a size of the obstruction based the outer sleeve shifting from the first position to the second position.

9. The method of claim 7, further comprising:

positioning an inner sleeve, comprising a plurality of stretchable elements connecting a plurality of panels to one another, in a third position, wherein the third position comprises the inner sleeve disposed concentrically around the second cylindrical rod between the outer sleeve and the second cylindrical rod.

10. The method of claim 9, wherein detecting the obstruction further comprises shifting the inner sleeve from the third position to a fourth position due to an interaction between the obstruction and the inner sleeve, wherein the fourth position comprises the inner sleeve concentrically disposed around the first cylindrical rod.

11. The method of claim 10, further comprising:

determining a size of the obstruction based on the inner sleeve shifting from the third position to the fourth position.

12. The method of claim 10, wherein shifting of the inner sleeve from the third position to the fourth position further comprises shearing pins that movably connected the inner sleeve to the second cylindrical rod, using a force of impact created by the interaction between the inner sleeve and the obstruction.

13. The method of claim 9, further comprising:

determining a size of the obstruction based on the outer sleeve shifting from the first position to the second position and the inner sleeve being retained in the third position.

14. The method of claim 9, wherein determining a size of the obstruction based on the outer sleeve shifting from the first position to the second position further comprises shearing pins that movably connect the outer sleeve to the inner sleeve, using a force of impact created by the interaction between the outer sleeve and the obstruction.

15. The method of claim 9, wherein obtaining an impression of the obstruction further comprises the impression block interacting with the obstruction when or after the outer sleeve shifts from the first position to the second position and the inner sleeve shifts from the third position to a fourth position.

16. The method of claim 7, wherein obtaining an impression of the obstruction further comprises the impression block interacting with the obstruction when or after the outer sleeve shifts from the first position to the second position.

17. A system for evaluating an obstruction in a conduit of a tubular comprising:

a deployment device connected to a first cylindrical rod and a second cylindrical rod, wherein the second cylindrical rod has a diameter larger than a diameter of the first cylindrical rod;

a first cylindrical sleeve stretchable to be disposed concentrically around the second cylindrical rod, wherein the first cylindrical sleeve is configured to:

disconnect from a first underlay due to a force of impact created by an interaction with the obstruction and contract and shift around the first cylindrical rod, wherein the system detects the obstruction by a contraction of the first cylindrical sleeve; and an impression block connected to the second cylindrical rod.

18. The system of claim 17, wherein the first underlay further comprises the second cylindrical rod and the system allows the deployment device to move past the obstruction after the contraction of the first cylindrical sleeve.

19. The system of claim 17, further comprising:

a second cylindrical sleeve stretchable to be disposed concentrically around the second cylindrical rod, beneath the first cylindrical sleeve, wherein the first underlay further comprises the second cylindrical sleeve and the second cylindrical sleeve is configured to:

disconnect from a second underlay due to the force of impact created by the interaction with the obstruction; and contract and shift around the first cylindrical rod, wherein the system detects the obstruction by a contraction of the first cylindrical sleeve and the second cylindrical sleeve.

20. The system of claim 17, further comprising:

a second to an n-th cylindrical sleeves stretchable to be disposed concentrically around the second cylindrical rod, beneath the first cylindrical sleeve, wherein n is an integer greater than two, wherein the second to the n-th cylindrical sleeves are configured to:

disconnect from an underlay due to a force of impact created by the interaction with the obstruction; and contract and shift around the first cylindrical rod.

* * * * *